US009203176B2

(12) United States Patent
Dong et al.

(10) Patent No.: US 9,203,176 B2
(45) Date of Patent: Dec. 1, 2015

(54) PLUG CONNECTOR

(71) Applicant: ADVANCED-CONNETEK INC., New Taipei (TW)

(72) Inventors: Fei-wu Dong, New Taipei (TW); Wei Wan, New Taipei (TW); Sheng-Chan Lin, New Taipei (TW); Shu-lin Duan, New Taipei (TW)

(73) Assignee: ADVANCED-CONNETEK INC., New Taipei (TW)

( * ) Notice: Subject to any disclaimer, the term of this patent is extended or adjusted under 35 U.S.C. 154(b) by 7 days.

(21) Appl. No.: 13/946,780

(22) Filed: Jul. 19, 2013

(65) Prior Publication Data

US 2014/0024263 A1 Jan. 23, 2014

(30) Foreign Application Priority Data

Jul. 20, 2012 (CN) ..... 2012 2 0354120 U
Jun. 25, 2013 (CN) ..... 2013 2 0368285 U

(51) Int. Cl.

| | |
|---|---|
| ***H01R 13/648*** | (2006.01) |
| ***H01R 13/516*** | (2006.01) |
| ***H01R 12/50*** | (2011.01) |
| ***H01R 12/71*** | (2011.01) |
| ***H01R 13/6594*** | (2011.01) |
| ***H01R 13/658*** | (2011.01) |

(52) U.S. Cl.

CPC ..... *H01R 13/516* (2013.01); *H01R 12/712* (2013.01); *H01R 12/716* (2013.01); *H01R 13/658* (2013.01); *H01R 13/6594* (2013.01); *H01R 23/6873* (2013.01)

(58) Field of Classification Search

CPC ..... H01R 13/6271; H01R 13/65802; H01R 12/712; H01R 12/716; H01R 13/6594; H01R 23/6873

USPC ..... 439/357, 607.17, 607.35, 607.4, 660

See application file for complete search history.

(56) References Cited

U.S. PATENT DOCUMENTS

| | | | | |
|---|---|---|---|---|
| 6,234,827 | B1 * | 5/2001 | Nishio et al. | 439/357 |
| 6,270,379 | B1 * | 8/2001 | Huang et al. | 439/660 |
| 6,817,898 | B2 * | 11/2004 | Tanaka et al. | 439/579 |
| 7,438,595 | B2 * | 10/2008 | Saito | 439/607.01 |
| 7,850,465 | B1 * | 12/2010 | Wan | H01R 12/712 439/607.4 |
| 8,052,431 | B1 * | 11/2011 | He et al. | 439/78 |
| 8,079,854 | B2 * | 12/2011 | He et al. | 439/108 |
| 8,287,299 | B2 * | 10/2012 | Ray et al. | 439/353 |
| 8,475,216 | B2 * | 7/2013 | Tung | H01R 13/506 439/607.4 |
| 8,708,718 | B2 * | 4/2014 | Li | H01R 4/027 439/108 |
| 8,851,927 | B2 * | 10/2014 | Hsu | H01R 13/6594 439/607.11 |
| 2011/0269322 | A1 * | 11/2011 | He et al. | 439/78 |
| 2011/0269341 | A1 * | 11/2011 | He et al. | 439/607.01 |
| 2013/0045629 | A1 * | 2/2013 | Zhu et al. | 439/607.55 |

* cited by examiner

*Primary Examiner* — Neil Abrams
*Assistant Examiner* — Travis Chambers
(74) *Attorney, Agent, or Firm* — Muncy, Geissler, Olds & Lowe, P.C.

(57) ABSTRACT

A plug connector is for connecting to a receptacle connector. The receptacle connector comprises two resilient plates. The plug connector has an insulating housing and a metal shell. The insulating housing includes a tongue portion and a base portion for accommodating and connecting the terminals. The metal shell has a top plate, bottom plate, and two side plates. Multiple recesses, protrusions or elongated recesses are selectively formed on at least one of the top plate, the bottom plate for connecting the resilient plates. These can avoid electromagnetic interference, dusts or any external substances from attaching to the insulating house and also ensure a high quality of the insertion force and the extraction force after frequent uses.

20 Claims, 29 Drawing Sheets

PLUG CONNECTOR

BACKGROUND OF THE INVENTION

1. Field of the Invention

The present invention relates to a plug connector, and more particularly to a plug connector which can avoid EMI, dusts or any external substances from attaching to the metal shell and also ensure stable insertion and extraction strength after frequent uses.

2. Description of the Prior Art

USB (Universal Serial Bus) connector is a type of connector that is widely used for the connection of electronic devices and related peripheral devices because of the advantages of easy connection to a device, plug-and-play and high efficiency of data transmission etc. Due to the upgrade of USB connectors, the ones with faster and more stable transmission function are needed.

Following the demands for transmission speed and storing capacity, the goal in industry standard is to achieve a transmission speed 10 times faster than the current speed. Adoption of the design structure of the current USB, one can improve the current one to obtain lower power consumption as well as higher performance from it, and make it to support the future fiber optic transmitting. Hence the transmission speed of USB 3.0 can reach 5 Gbps which is way higher than the speed of USB 2.0, i.e., 480 Mbps.

The general plug in the market usually has a metal shell and an insulating housing securely received in the metal shell and having therein multiple terminals. The metal shell usually is provided with two holes. When the USB plug connector is inserted into a corresponding receptacle connector, due to two snap plates formed on side a face of the receptacle connector, the two snap plates extend into the two holes of the metal shell of the connector and subsequently engage with the metal shell to satisfy connection requirements as well as ground requirement. While in application of the connector, EMI (electromagnetic interference), an electromagnetic phenomenon that will affect and eventually reduce the capability of the devices, equipment or systems. Hence this is another reason to consider when in design of the connector assembly in order to avoid loss of capability due to EMI. However, since there is no sheltering device to prevent influence from EMI, when the plug is to connect to the receptacle connector, EMI becomes the biggest concern for function stability.

Moreover, the two holes of the metal shell easily trap dust and debris of some kind and hence the function of the connector assembly is thus hindered.

Therefore, the present invention intends to resolve the aforementioned problems in the prior art.

SUMMARY OF THE INVENTION

To overcome the long-term problems, the present invention modifies the contact portion between the metal shell and the resilient portion of the receptacle connector. By using the stamping process on metal material to form at least one of recesses or protrusions, the plug connector could achieve excellent electromagnetic shielding function to make the resilient plates of the plug connector firmly with the metal shell. Thus it will prevent EMI and crosstalk problems and provide dust and debris prevention. By adopting the said metal material in the plug connector, it will ensure stable insertion and extraction strength after frequent uses and thus extend the lifetime of the plug connector.

According to the foresaid description, one aspect of the present invention is to provide a plug connector with a receptacle. By forming a plurality of the recesses with closed structures or partial openings selectively on at least one of the top plate and the bottom plate of the metal shell, it could prevent EMI efficiently, avoid dust or debris falling into the metal shell and ensure stable insertion and extraction strength.

According to another aspect of the present invention, a plug connects with the receptacle. By forming a plurality of protrusions with closed structures selectively on at least one of the top plate and the bottom plate of the metal shell, it could prevent EMI efficiently, avoid dust or debris falling into the metal shell and ensure stable insertion and extraction strength.

According to one aspect of the present invention, a plug connector is provided for connecting to the receptacle connector forms an elongated recess with closed structure or partial opening structure selectively on at least one of the top plate and the bottom plate of the metal shell. It will prevent EMI efficiently, dust or debris falling inside of the metal shell and ensure stable insertion and extraction strength.

According to the above aspects, the present invention provides a plug connector for connecting to a receptacle connector. The receptacle connector comprises a metal cover and forms a plurality of resilient plates on the front side and back side of the metal cover. The plug connector is characterized in an insulating housing and a metal shell. The insulating housing has a base portion and a tongue portion extending from the base portion. The base portion is in an upper position than the tongue portion. A plurality of first conductive terminals and second conductive terminals are retained in the insulating housing. The first conductive terminal has a first contact portion, a first elongated portion, a first connecting portion and a first soldering portion. The second conductive terminal has a second contact portion, a second elongated portion, a second connecting portion and a second soldering portion. The first conductive terminals and the second conductive terminals are interlaced up and down arranging set. The metal shell has a top plate, a bottom plate and two side plates. The two side plates are connecting to the top plate and the bottom plate for defining a receiving space. The insulating housing is retained in the receiving space and is assembled with the metal shell. Multiple recesses are formed on both or one of the top plate and the bottom plate for contacting a plurality of the resilient plates of the receptacle connector.

According to the foresaid aspects, the present invention provides a plug connector for connecting to a receptacle connector. The receptacle connector has a metal cover. A plurality of resilient plates form on the front side and the back side of the metal cover. The plug connector is characterized in an insulating body and a metal shell. The insulating housing has a base portion and a tongue portion extending from the base portion. The base portion is in an upper position than the tongue portion. A plurality of first conductive terminals and second conductive terminals are retained in the insulating housing. The first conductive terminal has a first contact portion, a first elongated portion, a first connecting portion and a first soldering portion. The second conductive terminal has a second contact portion, a second elongated portion, a second connecting portion and a second soldering portion. The first conductive terminals and the second conductive terminals are interlaced up and down arranging set. The metal shell has a top plate, a bottom plate and two side plates. The two side plates are connecting to the top plate and the bottom plate for defining a receiving space. The insulating housing is retained in the receiving space and is assembled with the metal shell. Multiple protrusions are formed on both or one of the top plate and the bottom plate for contacting a plurality of the resilient plates of the receptacle connector.

According to the foresaid aspects, the present invention provides a plug connector for connecting to a receptacle connector. The receptacle connector has a metal cover. A plurality of resilient plates form on the front side and the back side of the metal cover. The plug connector is characterized in an insulating body and a metal shell. The insulating housing has a base portion and a tongue portion extending from the base portion. The base portion is in an upper position than the tongue portion. A plurality of first conductive terminals and second conductive terminals are retained in the insulating housing. The first conductive terminal has a first contact portion, a first elongated portion, a first connecting portion and a first soldering portion. The second conductive terminal has a second contact portion, a second elongated portion, a second connecting portion and a second soldering portion. The first conductive terminals and the second conductive terminals are interlaced up and down arranging set. The metal shell has a top plate, a bottom plate and two side plates. The two side plates are connecting to the top plate and the bottom plate for defining a receiving space. The insulating housing is retained in the receiving space and is assembled with the metal shell. An elongated recess is formed selectively on both or one of the top plate and the bottom plate for contacting a plurality of the resilient plates of the receptacle connector.

Thus, the present invention makes it possible to stabilize the overall connector structures, simplify the assembly process, unify the connector elements and resolve EMI happened in the metal shell with holes showing in the prior art.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

The present invention discloses a plug connector. The object of the present invention is to form recesses and protrusions with use of stamping process on the top plate and the bottom plate of the metal shell to provide an overall shielding or partial protruding structures. It can avoid electromagnetic interference (EMI) and dusts or any external substances from attaching to the metal shell. It also ensures a high quality of the electrical connection after frequent uses of the plug connector. Furthermore, the basic principle and the function of the present invention, especially for the structure of the plug connector, are known to those of ordinary skill in the art and thus omitted in the following description for clarity and conciseness. Furthermore, the following description of exemplary embodiments of the present invention are provided for illustrative purposes only and not for the purpose of limiting the present invention as defined by the appended claims and their equivalents.

Figure 1A:
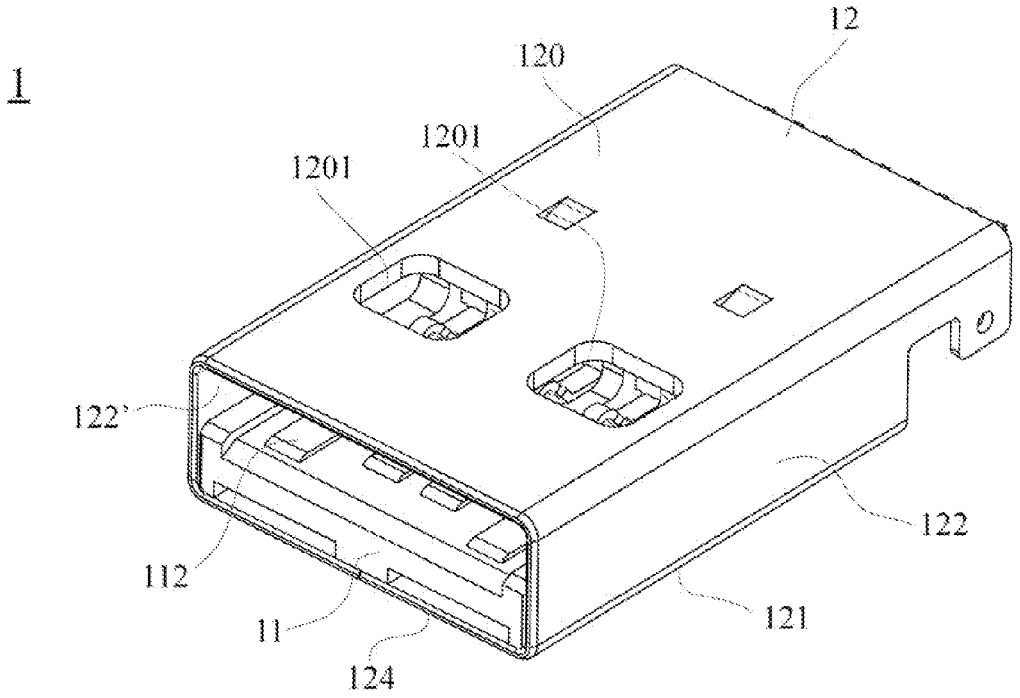
FIG. 1A is a perspective view of a plug connector according to an embodiment of the present invention.
Figure 1B:
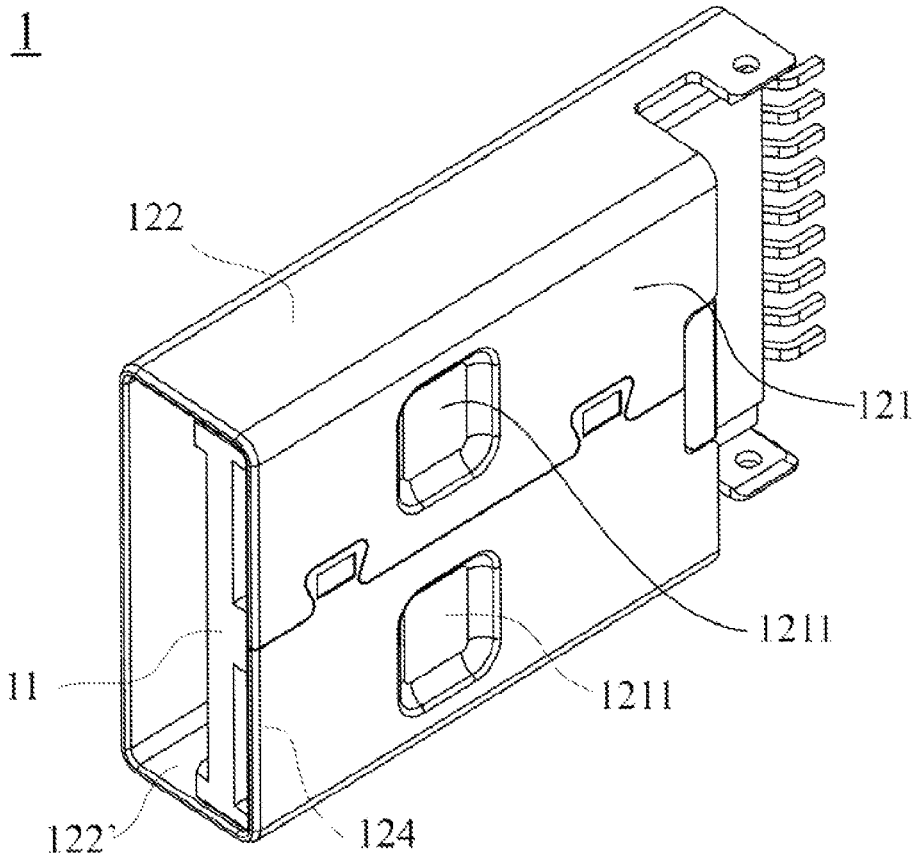
FIG. 1B is a perspective view of the plug connector viewed from another aspect.
Figure 2:
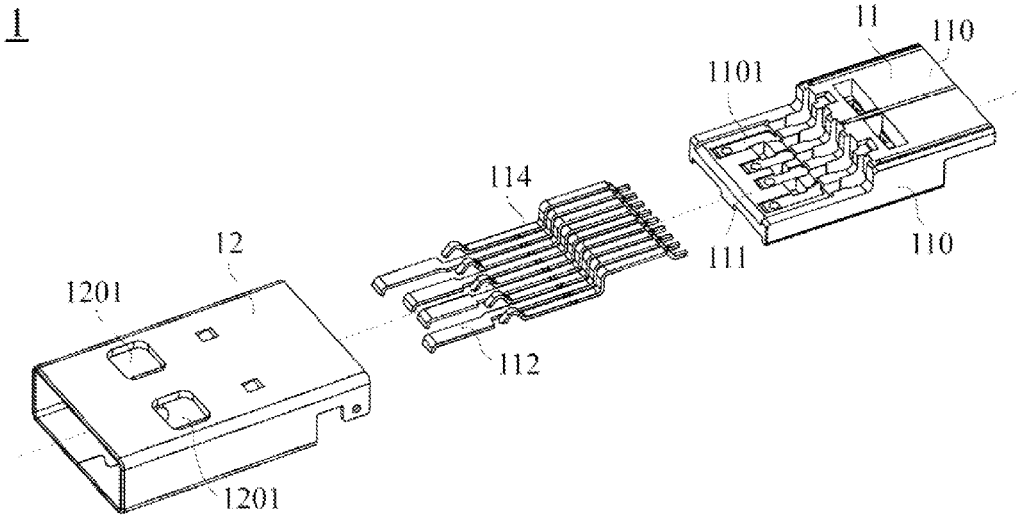
FIG. 2 is an exploded view of the plug connector shown in the FIG. 1A and FIG. 1B.

Referring to FIG. 1A which is a perspective view of a plug connector according to an embodiment of the present invention. FIG. 1B is a perspective view of the plug connector viewed from another aspect. FIG. 2 is an exploded view of the plug connector shown in the FIG. 1A and FIG. 1B. The plug connector 1 comprises an insulating housing 11 and a metal shell 12. The insulating housing 11 has a base portion 110 and a tongue portion 111 extending outwardly from the base portion 110. The base portion 110 is in an upper position than the tongue portion 111 to form as a ladder shape which can be presented explicitly in FIG. 2. The insulating housing 11 receives a plurality of first conductive terminals 112 and a plurality of second conductive terminals 114, both of which are combined with each other and retained in the metal shell 12. The insulating housing 11 and the metal shell 12 are assembled integrally as the plug connector 1. Furthermore, each of the first conductive terminals 112 and each of the second conductive terminals 114 are aligned and parallel to each other. The second conductive terminals 114 are spaced from each other. Accordingly, spaces or clearances are formed between the second conductive terminals 114, and the first conductive terminals 112 are located in or below the spaces or clearances. Thus, in a vertical view or in a bottom view, the first conductive terminals 112 and the second conductive terminals 114 are interlaced up and down arranging set. The above is only one embodiment of the present invention, and the present invention is not limited to any particular embodiment disclosed. For example, the first conductive terminals 112 could be located above the spaces or clearances. This is also a preferred embodiment of the present invention.

Figure 4A:
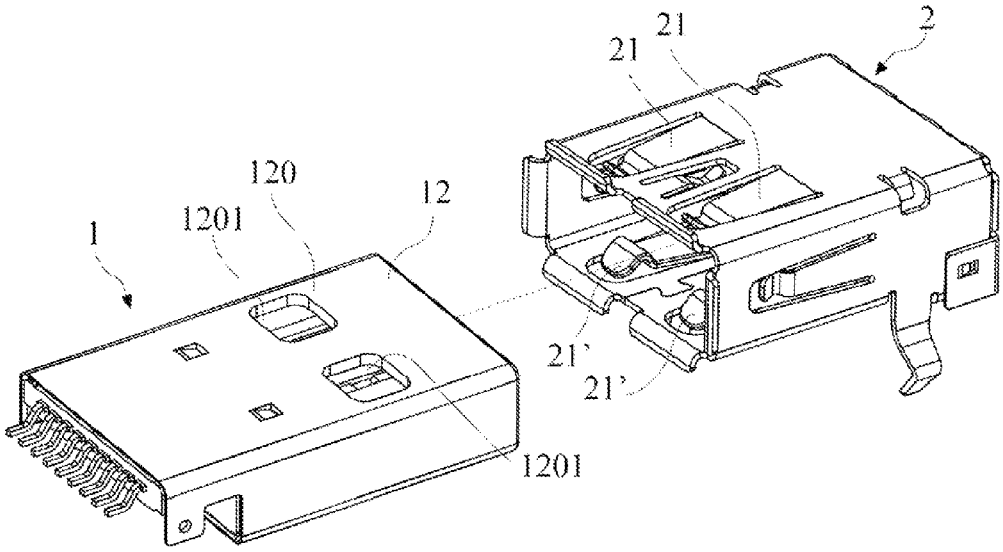
FIGS. 4A-4B are perspective views of the plug connector and the receptacle connector shown in the FIG. 1A and FIG. 1B.
Figure 4B:
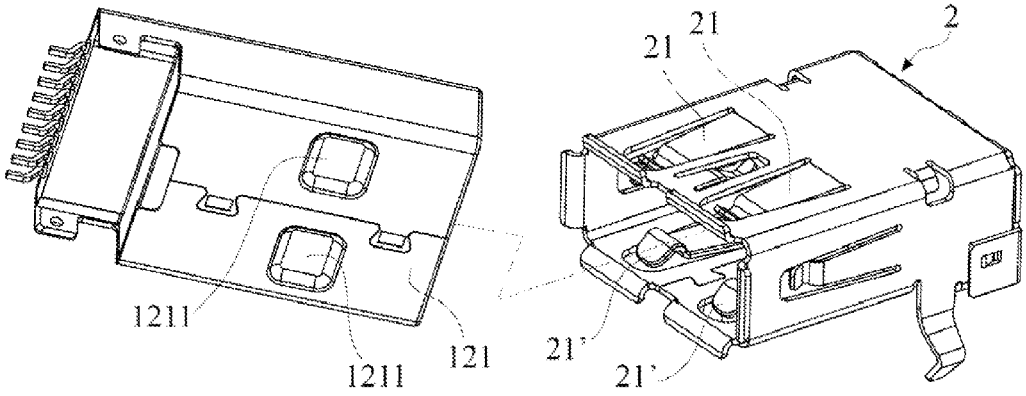

Referring to FIGS. 1A and 1B, the metal shell 12 comprises a top plate 120, a bottom plate 121 opposite to the top plate 120, and two side plates 122,122'. The two side plates 122, 122' are connected to the top plate 120 and the bottom plate 121 and define a receiving space 124. The insulating housing 11 is retained in the receiving space 124. Thus, the insulating housing 11 with a plurality of the first conductive terminals 112 and the second conductive terminals 114 will be combined with the metal shell 12. In this embodiment, the metal shell 12 is made of one kind of metal substances by stamping process. In FIG. 1B, multiple recesses 1211 are depressed from the bottom plate 121 of the metal shell 12. For example, the two recesses 1211 with geometric configurations are formed. In FIG. 1A, the two traditional locating portions 1201 with traditional holes are formed or penetrated on the top plate 120 opposite to the bottom plate 121. In FIGS. 4A and 4B, the two locating portions 1201 receive the resilient plates 21, 21' of the receptacle connector 2. In a preferred embodiment, the recess 1211 could be rectangle and depressed with closed configuration. Thus, the plug connector 1 will have an intact metal shell 12 providing fine shielding function for the insulating housing 11.

Figure 3:
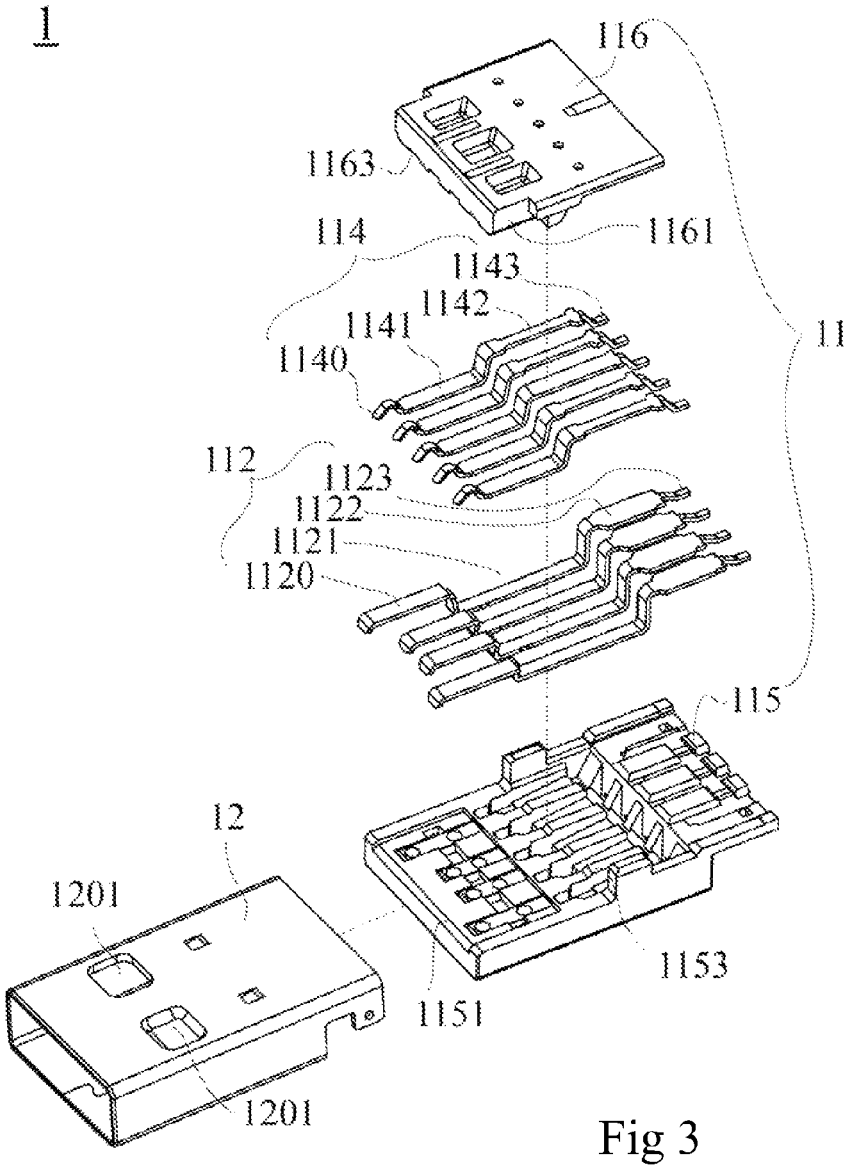
FIG. 3 is an exploded view of the plug connector shown in the FIG. 1A and FIG. 1B.

Please refer to FIG. 3 which is an exploded view of the plug connector shown in the FIG. 1A and FIG. 1B. The configuration of the metal shell 12 is similar with the metal shell 12 in FIG. 2. But the structure of the insulating housing 12 shows the difference disclosed in FIG. 2 and FIG. 3. The insulating housing 12 could accommodate a plurality of the first conductive terminals 112 and the second conductive terminals 114 as said before. The insulating housing 12 in the FIG. 3 further discloses a first body 115 and a second body 116. The top surface 1151 of the first body 115 comprises a first terminal receiving space 1153 for retaining a plurality of the first conductive terminals 112. The first conductive terminal 112 includes a first contact portion 1120, a first elongated portion 1121, a first connecting portion 1122, and a first soldering portion 1123. The first contact portion 1120 extends upwardly toward one end of the first elongated portion 1121 and then bends. Thus it forms a height difference between the first contact portion 1120 and the first elongated portion 1121. Furthermore, the first connecting portion 1122 extends upwardly from the other side of the first elongated portion 1121 and bends, and it also forms a height difference between the first connection portion 1122 and the first elongated portion 1121. Therefore, the first elongated portion 1121 becomes a U shape. The first soldering portion 1123 extends from the first connecting portion 1122 backwardly. Thus when the first conductive terminals 112 are attached to the first terminal receiving space, the first soldering portion 1123 will extend from the backside of the first terminal receiving space 1153. The bottom surface 1161 of the second body 116 comprises a second terminal receiving space 1163 for receiving a plurality of the second conductive terminals. The second conductive terminal 114 comprises a second contact portion 1140, a second elongated portion 1141, a second connecting portion 1142 and a second soldering portion 1143. The second contact portion 1140 and the second elongated portion 1141 are attached on the U shape of the first elongated portion 1121. This will keep the second contact portion 1140 and the first contact portion 1120 in the same surface level. It will also form a height difference between the second contact portion 1142, which is extending upwardly and bending, and the second elongated portion 1141. When the second conductive terminals 114 are retained in the second terminal receiving space 1163, the second contact portion 1140 and the second soldering portion 1143 will extend from two sides of the second terminal receiving space 1163. In addition, when the second body 116 covers the top surface 1151 of the first body 115, the first contact portion 1120 retaining in the first terminal receiving space 1153 and the second contact portion 1140 extending from the second terminal receiving space 1164 will be exposed. Hence, the plug connector shown in the FIG. 1 is assembled when the insulating housing 11 accommodating the first conductive terminals 112 and the second conductive terminals 114 is inserted into the metal shell 12. The plug connector disclosed above is only one preferred embodiment of the present invention. For example, the insulating housing, the first conductive terminals and the second conductive terminals could be integrally molded to form the plug connector, which is also one embodiment of the present invention.

Please Refer to FIGS. 4A-4B which are perspective views of the plug connector and the receptacle connector shown in the FIG. 1A and FIG. 1B. The plug connector 1 connects to a receptacle connector 2. The receptacle connector 2 is a metal cover. The front side and the back side of the metal cover form two resilient plates 21, 21' respectively. When the plug connector 1 connects to the receptacle connector 2, the metal shell 12 of the plug connector 1 will be accommodated in the receptacle connector 2. Two locating portion 1201 on the top plate 120 of the metal shell 12 (shown in FIG. 4A) and two recesses 1211 on the bottom plate 121 of the metal shell 12 (shown in FIG. 4B) will contact the resilient plates 21, 21' of the receptacle connector 2. For example, the resilient plates 21 will lock the locating portion 1201, and the resilient plates 21' will contact to the bottom or the periphery of the recesses 1211. Thus the electrical connection is established and the grounding is achieved. Moreover, the recess stamped from the bottom plate 121 of the metal shell 12 is a closed structure. When the plug connector 1 and the receptacle connector 2 combined, it will prevent any clearance happened. It also avoids any dusts or substances fallen from such clearance into the metal shell 12 to render the failed connection between the first conductive terminals 112 and the second conductive terminals 114. It is emphasized that to compare with the metal shell with holes disclosed in the prior art, the plug connector 1 of the present invention (shown in FIG. 2 and FIG. 3) with an more intact metal structure provides a well-shielding function and a stable connection between the resilient plates 21, 21' of the receptacle connector 2 and the metal shell 12. This will prevent the leakage of the electromagnetic wave and the exterior intervention of the electromagnetic wave. Furthermore, it also prevents dusts and any tiny substances to intervene the connection and provides stable insertion force and the extraction force. The related test datum will be explained in the following embodiment. Obviously, the modification of this embodiment resolves the long-term problems of the plug connector.

Figure 5:
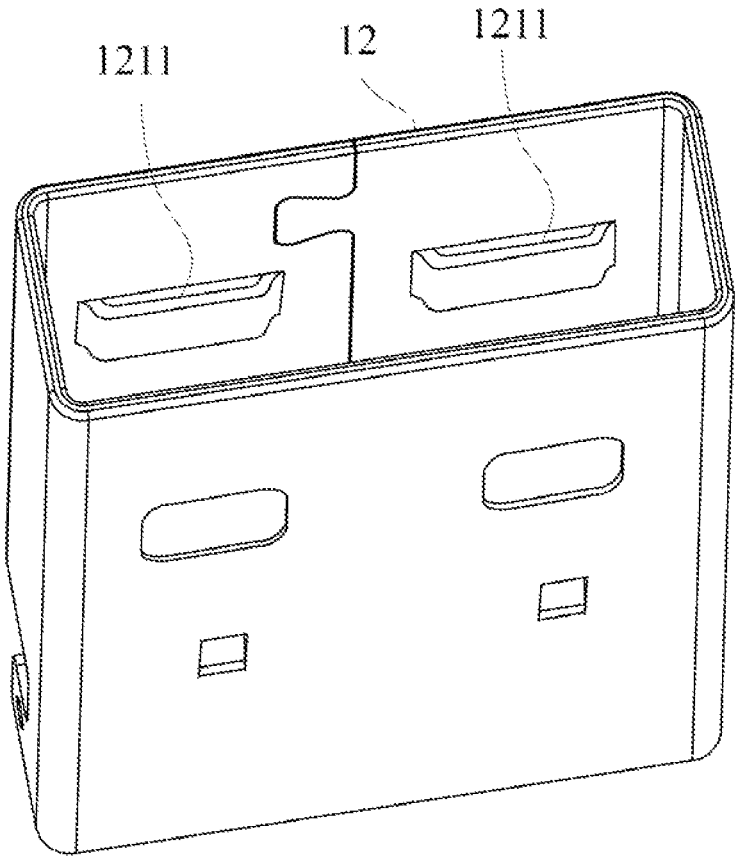
FIG. 5 is another perspective view of the metal shell shown in FIG. 1A and FIG. 1B.

Please refer to FIG. 5 which is another perspective view of the metal shell illustrating the metal shell in FIG. 1A and FIG. 1B. According to the embodiment disclosed in FIGS. 1A-4B, the multiple recesses 1211 formed on the bottom plate 121 of the metal shell 12 is a closed-rectangle structure. Please refer to the embodiment disclosed in FIG. 5. The recess 1211 is alternatively with an opening, which is formed by stamping process. For example, by controlling the compression position and intensity, the opening will be formed on the bottom of the each of the recesses 1211. In this embodiment, the two opposite opening structures are formed on the partial bottom periphery of the recess 1211 shown in FIG. 5. Such opening structure could be stamped with lower compression force to form a slit. This could also achieve EMI-prevention and dust prevention, avoid the inner leakage or the exterior intervention of electromagnetic wave, and provide stable insertion and extraction function as said before.

It is emphasized that plug connector with the recesses having closed or partial opening structure stamped on the bottom plate of the metal shell in the foresaid embodiment has been experienced over 1500 insertion and extraction tests. The test records indicate that the average extraction force of the plug connector with closed recesses is 24.3550 N (newton), and the one with penetrated recesses is 31.3972 N. Both kinds of the plug connectors are complied with the world connector standards, which regulates the extraction force must be greater than 10 N and are superior to general plug connectors. This design prevents the plug connector from loosening or disengaging during the electrical connection and ensures a stable insertion and extraction function after frequent uses.

Figure 6A:
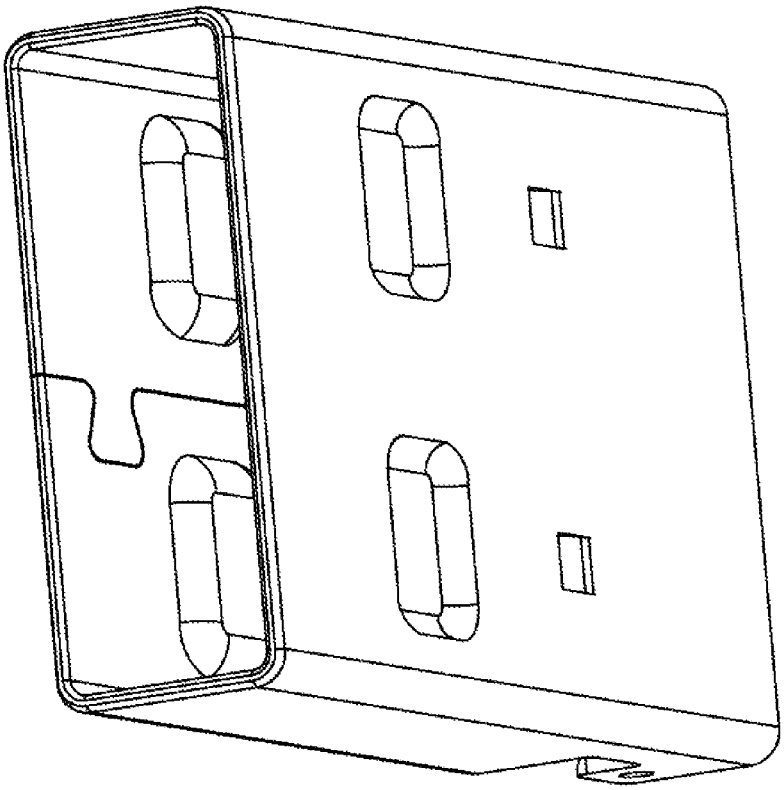
FIGS. 6A-6B are perspective view of the metal shell of the present invention.
Figure 6B:
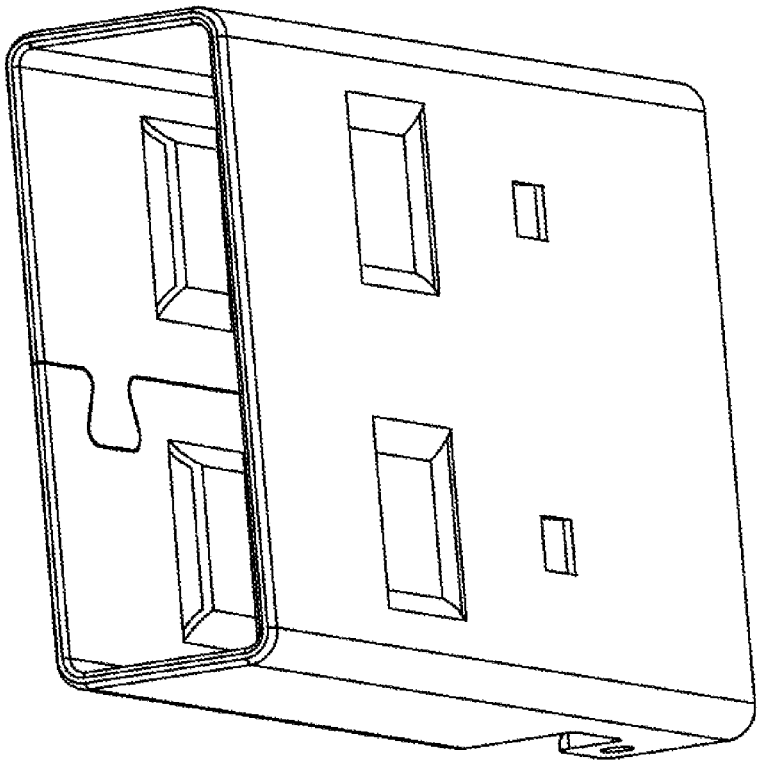

In addition, the foresaid embodiment of the present invention discloses the locating portions 1201 with traditional holes on the top plate 120 of the metal shell 12 and the recesses 1211 with closed structures or opening structures on the partial periphery of the bottom of the recesses by stamping process. Alternatively, the locating portions 1201 could be recesses with closed structures (shown in FIG. 6A) or with partial opening structures (shown in FIG. 6B) on the top plate 120 of the metal shell 12. Thus both of the top plate 120 and the bottom plate 121 of the metal shell 12 comprise recesses 1211 with closed structures or with partial opening structures. Due to such structures both on the top plate 120 and the bottom plate 121 of the metal shell 12 or on one of the top plate 120 and the bottom plate 121, it ensures the resilient plates 21, 21' of the receptacle connector 2 having excellent contact with the metal shell 12 and further provides EMI and dust prevention function.

Figure 7:
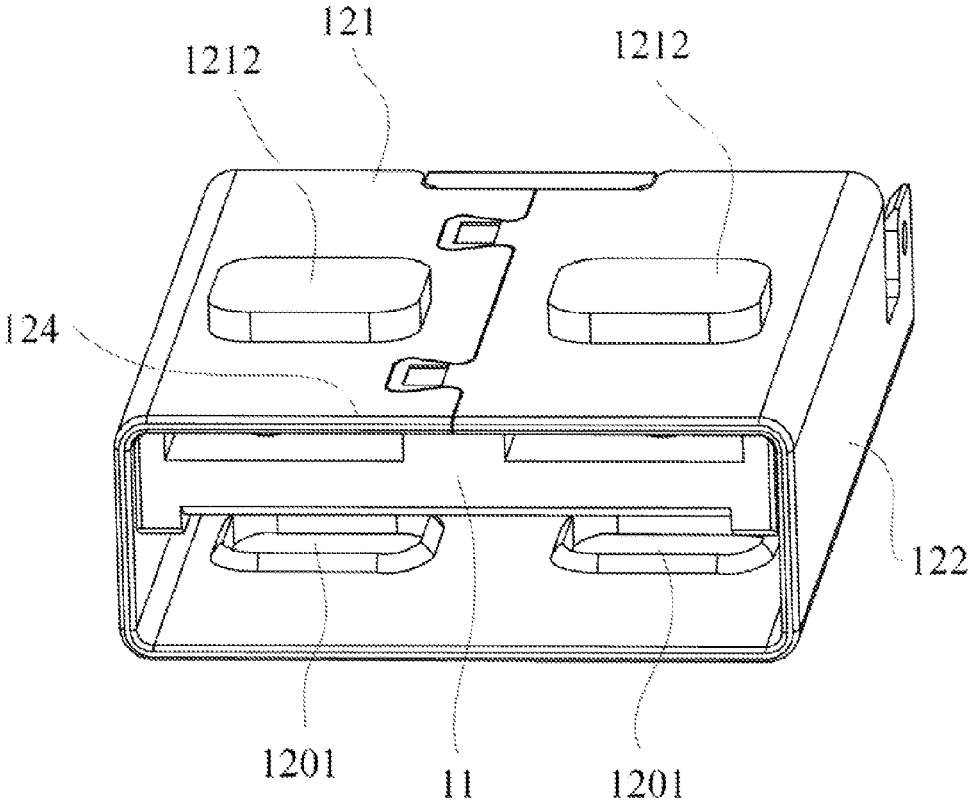
FIG. 7 is a perspective view of the plug connector according to another embodiment of the present invention.
Figure 8A:
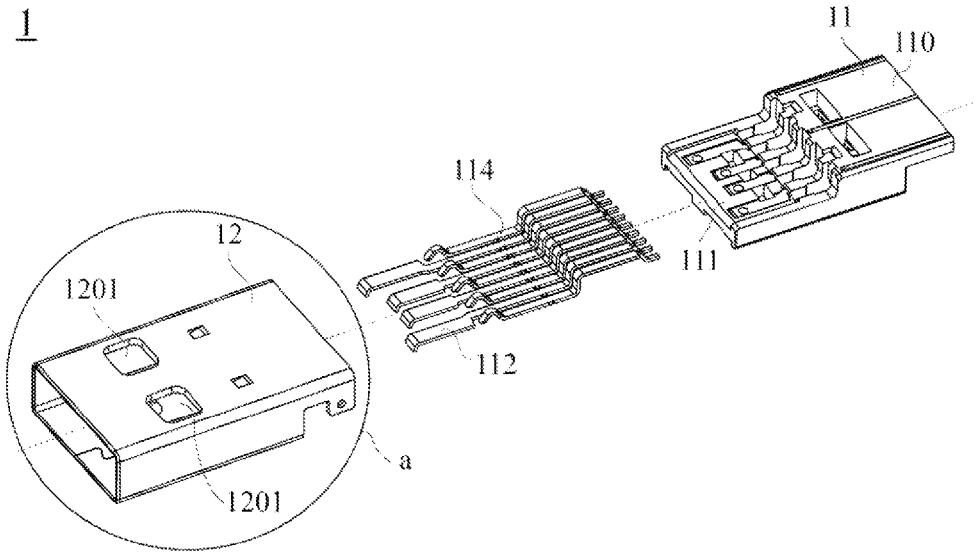
FIG. 8A is an exploded view of the plug connector shown in FIG. 7.
Figure 8B:
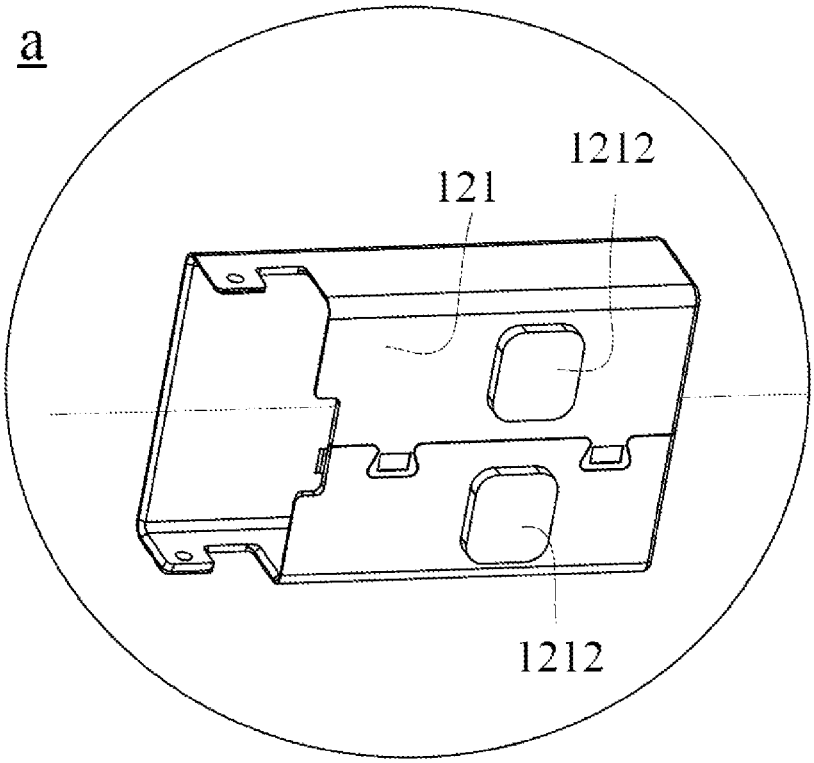
FIG. 8B is an enlarged view of the metal shell shown in FIG. 7.

Please refer to FIGS. 7-8B. FIG. 7 is a perspective view of the plug connector according to another embodiment of the present invention. FIG. 8A is an exploded view of the plug connector shown in FIG. 7. FIG. 8B is an enlarged view of the metal shell shown in FIG. 7. The plug connectors in FIGS. 7-8B are similar with the ones disclosed in FIGS. 1A-2 except for the bottom plate 121 of the metal shell 12, and the detail structure of the plug connector 1 will be omitted in the following for clarity and conciseness. In this embodiment, the bottom plate 121 of the metal shell 12 (a, shown in FIG. 8B) is stamped outwardly to form a plurality of protrusions 1212. For example, the two protrusions 1212 are with geometric configurations. The locating portions 1201 with traditional holes (a, shown in FIG. 8A) formed on the top plate 120 of the metal shell 12 for contacting the two resilient plates 21, 21' of the receptacle connector 2. In a preferred embodiment, the protrusions 1212 could be rectangle structures with different sizes. Besides, spaces will not exist when the plug connector 1 and the receptacle connector 2 assembled because of the protrusions 1212 with closed structures stamped outwardly from the bottom plate 121 of the metal shell 12. This will avoid any dust or tiny substances in the spaces around the resilient plates 21, 21' drop into the metal shell 12 to fail the electrical connection. It is emphasized that comparing with the metal shell in the prior art, the metal shell 12 with openings of the plug connector 1 in this embodiment are with an intact metal structure to form an excellent shielding function for the resilient plates 21, 21' of the receptacle connector 2 and the metal shell 12. It will avoid EMI and prevent the leakage of the electromagnetic wave from the inner of the metal shell 12 and the exterior intervention of the electromagnetic wave happened in the metal shell 12. Moreover, it will achieve dust prevention function and also ensure stable insertion and extraction function after frequent uses of the plug connector 1 and the receptacle connector 2. Obviously, the modification of the embodiment could resolve the long-term problems existing in the plug connector 1.

Figure 9A:
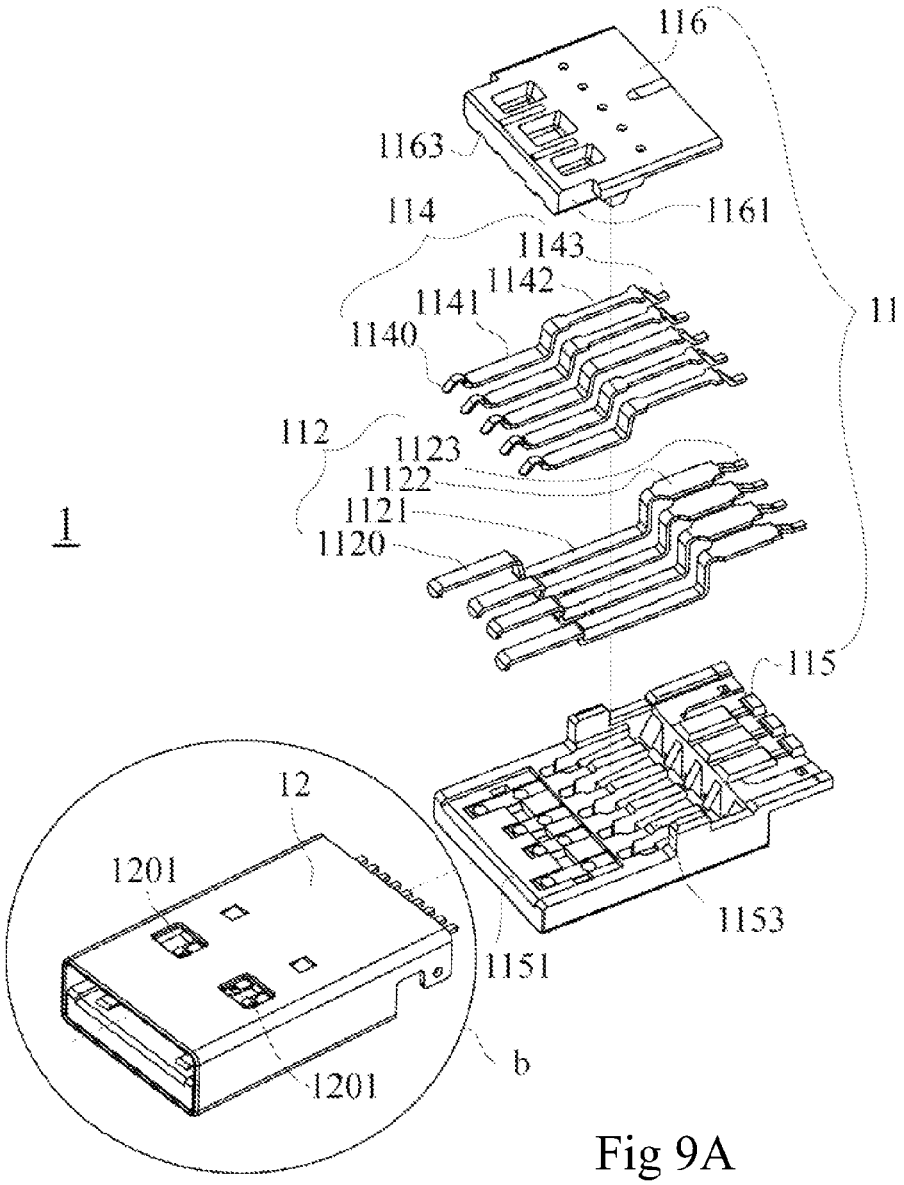
FIG. 9A is an exploded view of the plug connector shown in the FIG. 7.
Figure 9B:
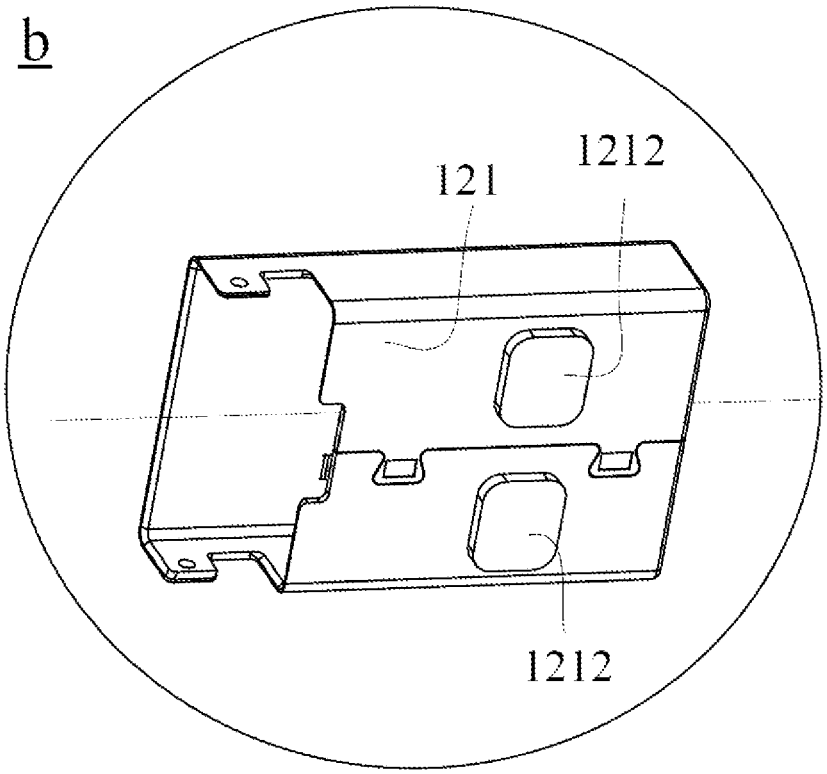
FIG. 9B is another perspective view of the metal shell shown in the FIG. 7.

Please refer to FIG. 9A which is an exploded view of the plug connector shown in the FIG. 7 and FIG. 9B which is another perspective view of the metal shell shown in FIG. 7. This embodiment discloses a different insulating housing 11 from the one disclosed in FIGS. 8A-8B. The insulating housing 11 in this embodiment is the same with the one in FIG. 3. The first conductive terminals 112 and the second conductive terminals 114 retained in the insulating housing 11 comply with USB 3.0 transmission standard. Hence, the USB 3.0 plug connector is assembled when the insulating housing 11 covered by the metal shell 12. Contrary to the design of the recess 1211 in the foresaid embodiment, the protrusions 1212 stamped outwardly from the bottom plate 121 of the metal shell 12 also provide the same dust prevention function as said before. The insulating housing 11 shown in FIG. 9A is the same with the one shown in FIG. 3 and will be omitted in the following for clarity and conciseness.

Figure 10A:
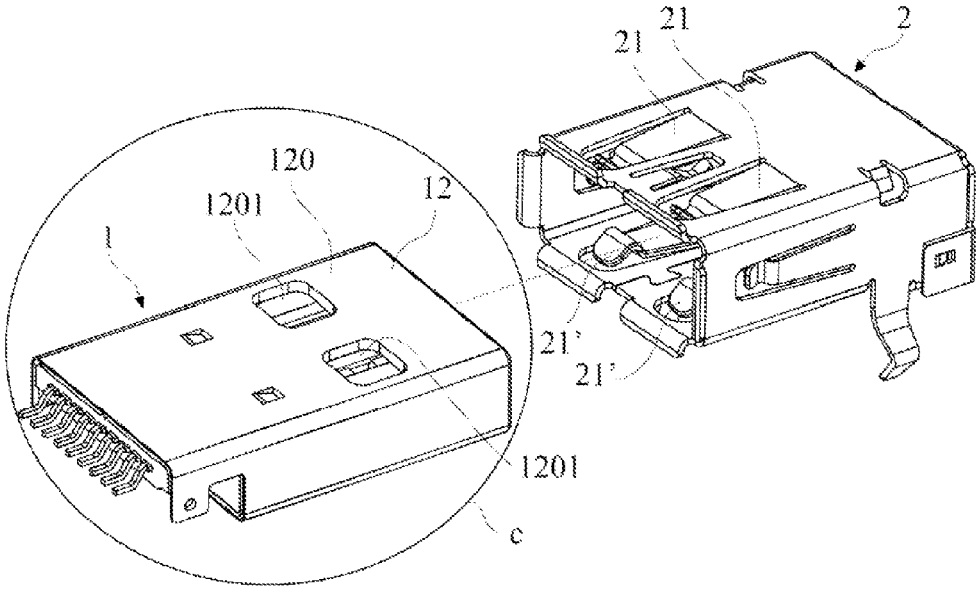
FIGS. 10A-10B are a perspective views of the plug connector and the receptacle connector shown in the FIG. 7.
Figure 10B:
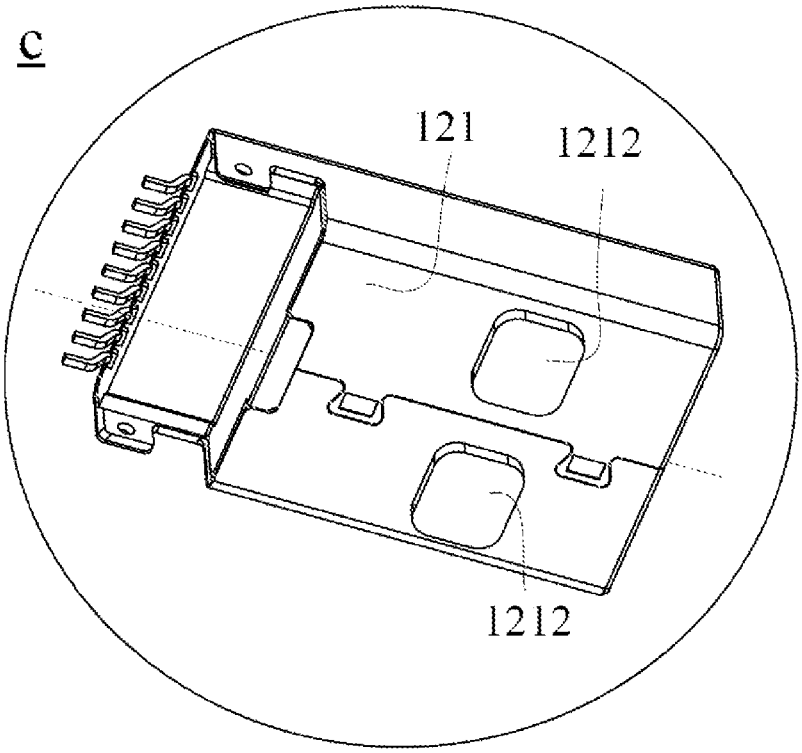

Referring to FIGS. 10A-10B, the plug connector 1 is provided for connecting to the receptacle connector 2. The receptacle connector 2 is a metal cover. The two resilient plates 21, 21' respectively form on the front side and the back side of the metal cover. When the plug connector 1 connects with the receptacle connector 2, the metal shell 12 of the plug connector 1 will be received in the receptacle connector 2. Hence, the two locking portions 1201 (c, shown in FIG. 10A) penetrated from the top plate 120 of the metal shell 12 and the two protrusions 1212 (c, shown in FIG. 10B) of the bottom plate 121 will connect to the resilient plates 21, 21' respectively forming on the front side and the back side of the receptacle connector 2. For example, the resilient plates 21 will lock the locating portions 1201, and the resilient plates 21' will connect to the bottom of the protrusions 1212 or the periphery of the protrusions 1212. This will generate the electrical connection between the plug connector 1 and the receptacle connector 2 to achieve the grounding function. Furthermore, the protrusion 1212 stamped on the bottom plate 121 of the metal shell 12 is a closed structure. When the plug connector 1 and the receptacle connector 2 assembled, no spaces will be happened. It will avoid dust or tiny substances falling into the metal shell 12, which will fail the connection between the first conductive terminals 112 and the second conductive terminals 114. It is indicated that after the modification disclosed in the present invention (shown in FIGS. 8A-9B), the plug connector 1 further has opening structures comparing with the one disclosed in the prior art. Consequently, the plug connector 1 of the present invention provides an intact metal structure to form an excellent shielding function and ensure a good connection between the resilient plates 21, 21' of the receptacle connector 2 and the metal shell 12. This will avoid EMI and prevent the leakage of the electromagnetic wave and the exterior intervention of the electromagnetic wave to the metal shell 12. Furthermore, it will achieve dust prevention function and also ensure stable insertion and extraction function after frequent uses of the plug connector and the receptacle connector. Obviously, this embodiment provides the solution for the long-term problem existing in the use of the plug connector.

Similarly, this embodiment adopts the way of a locating portion 1201 with traditional hole formed on the top plate 120 of the metal shell 12 and the protrusions 1212 with closed structures formed on the bottom plate 121 of the metal shell 12. Selectively, the locating portion 1201 of the top plate 121 of the metal shell 12 could be with closed protrusions 1212. Thus both of the top plate 120 and the bottom plate 121 of the metal shell 12 form a plurality of protrusions 1212 (shown in FIG. 11) respectively. The rectangle protrusions 1212 could be with different sizes. The objective of the protrusions 1212 with closed structures stamped on both or one of the top plate 120 and the bottom plate 121 is to achieve good connection between the two resilient plates 21, 21' of the receptacle connector 2 to provide EMI prevention and the dust prevention function.

Figure 12:
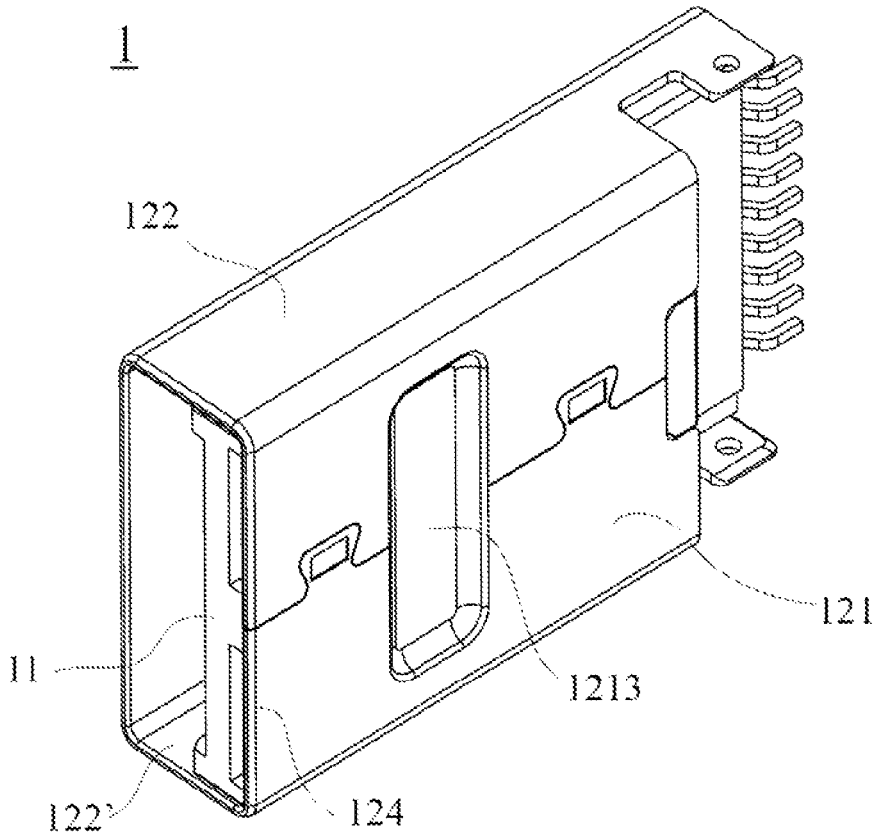
FIG. 12 is a perspective view of the plug connector according to one embodiment of the present invention.
Figure 13A:
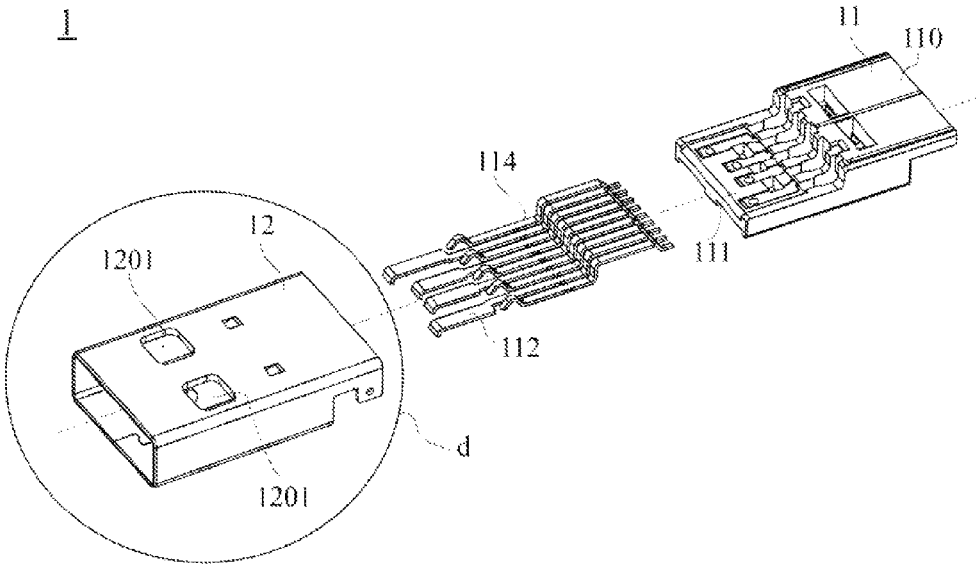
FIGS. 13A-13B are exploded views of the plug connector shown in FIG. 12.
Figure 13B:
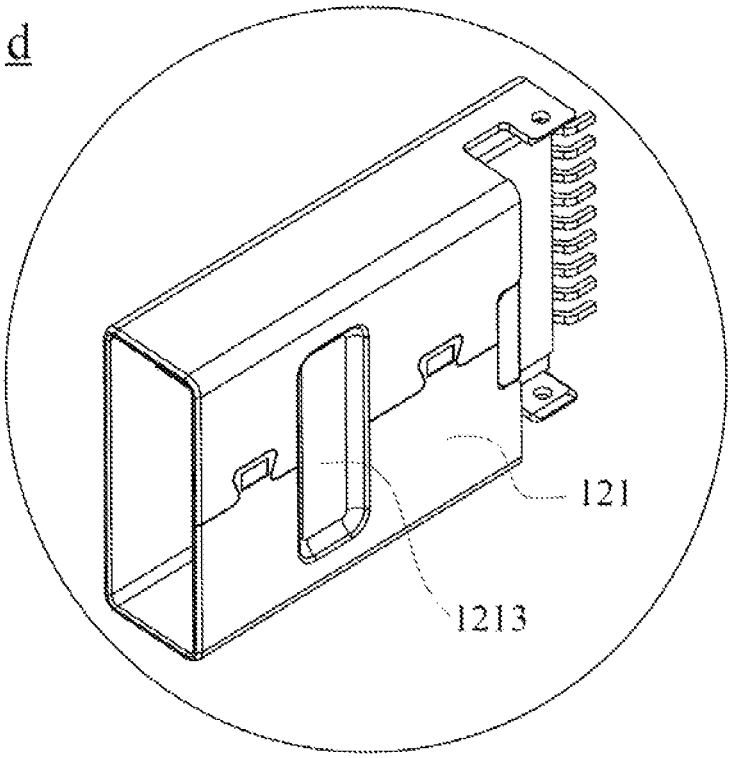

Please refer to FIG. 12 which is a perspective view of the plug connector according to one embodiment of the present invention and FIGS. 13A-13B are exploded views of the plug connector shown in FIG. 12. The plug connector 1 of this embodiment provides the similar elements of the plug connector 1, which will be omitted in the following, with the one in FIGS. 1A-2 but different structure of the bottom plate 121 of the metal shell 12. According to FIG. 12, the elongated portion 1213 (a, shown in FIG. 13B) stamped on the bottom plate 121 of the metal shell 12. The top plate 120 opposite to the bottom plate 121 forms two locating portions 1201 (d, shown in FIG. 13A) for connecting the resilient plates 21, 21' forming on the front side and the back side of the receptacle connector 2. In a preferred embodiment, the elongated recesses 1213 could be rectangle structures with different sizes. Besides, the elongated recesses 1213 are with closed structures stamped on the bottom plate 121 of the metal shell 12. It will avoid any spaces happened when the plug connector 1 and the receptacle connector 2 assembled. Furthermore, it will also prevent any dust or tiny substances falling from spaces of resilient plates 21' into the metal shell 12, which tends to fail the connection between the first conductive terminals 112 and the second conductive terminals 114 of the plug connector 1. Hence, comparing to the metal shell in the prior art, the embodiment discloses the metal shell 12 with opening structure which provides excellent shielding function for the resilient plates 21, 21' of the receptacle connector 2 and the metal shell 12 to achieve stable connection. This will avoid EMI and prevent the leakage of the electromagnetic wave in the metal shell 12 and the exterior intervention of the electromagnetic wave into the metal shell 12. Furthermore, it will achieve dust prevention function and also ensure stable insertion and extraction function after frequent uses of the plug connector and the receptacle connector. Obviously, this embodiment improves the long-term problem existing in the use of the plug connector.

Figure 14A:
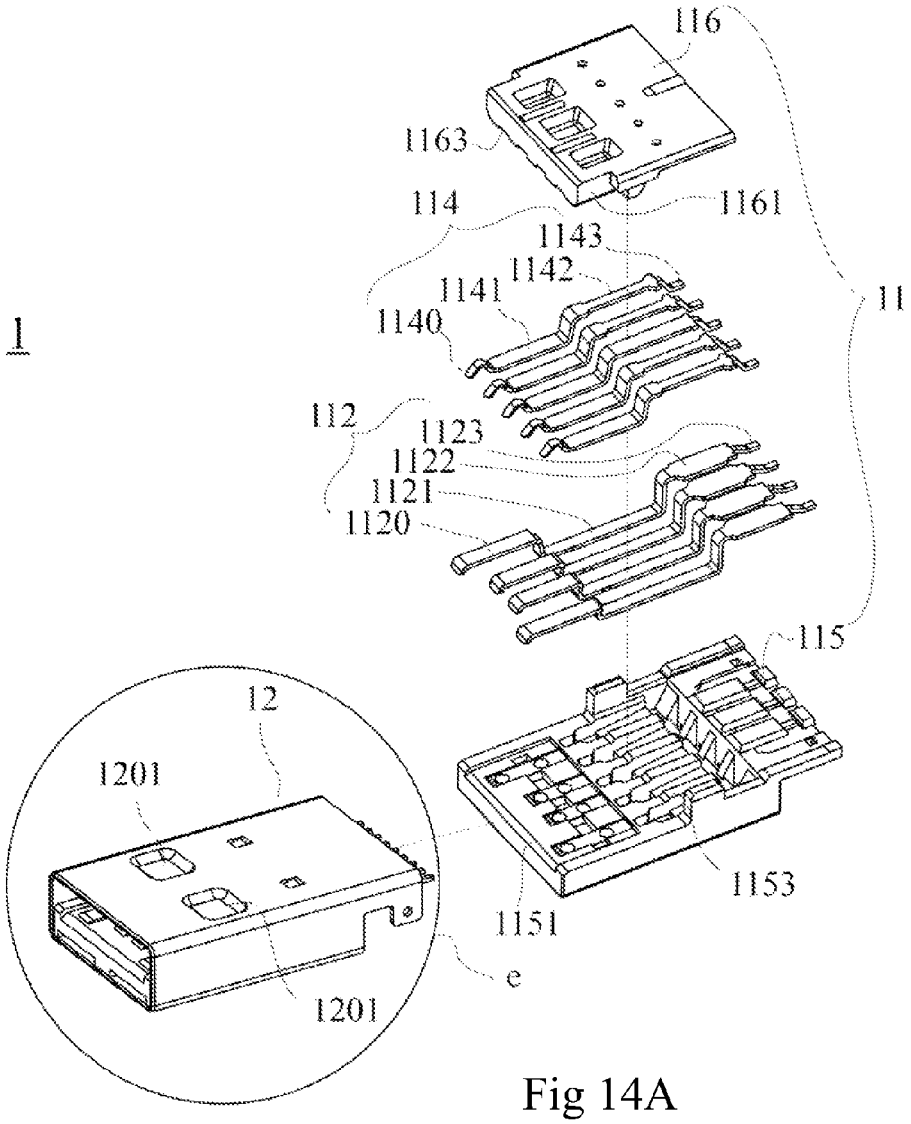
FIG. 14A is an exploded view of the plug connector shown in FIG. 12.
Figure 14B:
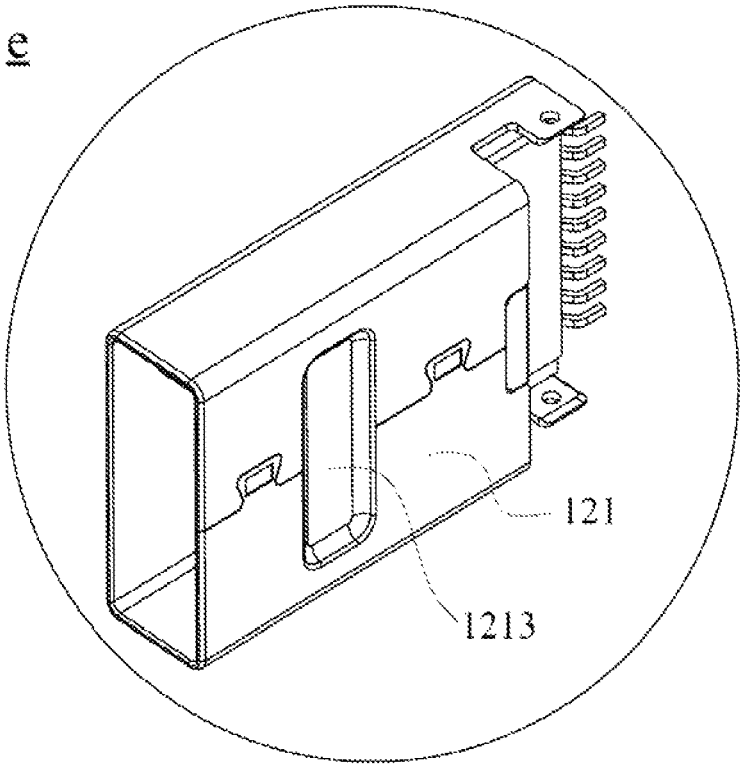
FIG. 14B is another perspective view of the plug connector shown in FIG. 12.

Please refer to FIG. 14A which is an exploded view of the plug connector shown in FIG. 12 and FIG. 14B which is another perspective view of the plug connector shown in FIG. 12. This embodiment provides the bottom plate 121 of the metal shell 12 different from the foresaid embodiments. The bottom plate 121 of the metal shell 12 forms elongate portions 1213 (e, shown in FIG. 14B) instead the two recesses in the foresaid embodiment. Opposite to the bottom plate 121 of the metal shell 12, the two locating portions 1201 with protrusion structures form on the top plate 120 of the metal shell 12 (e, FIG. 14A) for contacting two resilient plates 21, 21' of the receptacle connector 2. In a preferred embodiment, the elongated recesses 1213 are with closed structures to avoid dust or tiny substances falling into the metal shell 12. The insulating body 11 in FIG. 14A is the same with the one in FIG. 11 and will not be described further.

Figure 11:
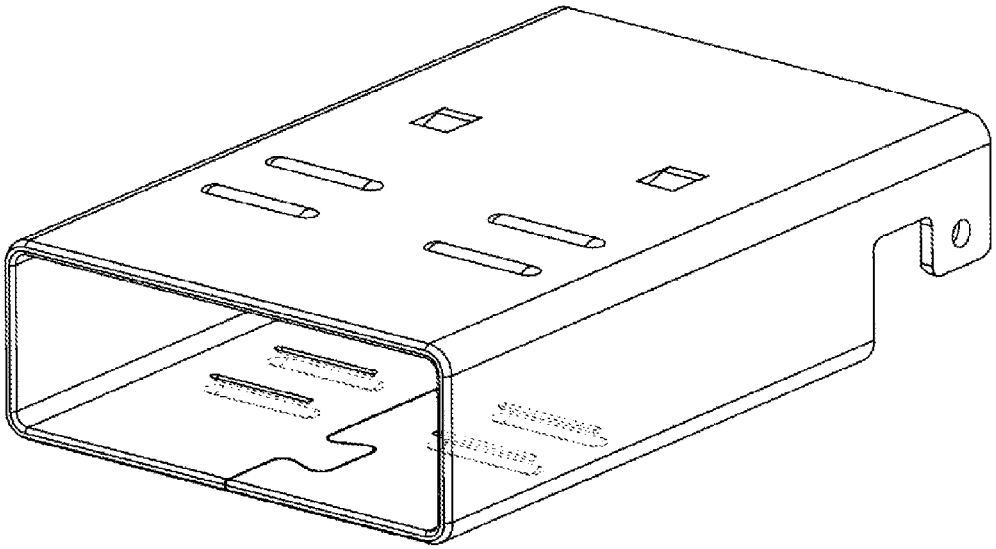
FIG. 11 is a perspective view of the metal shell.
Figure 15A:
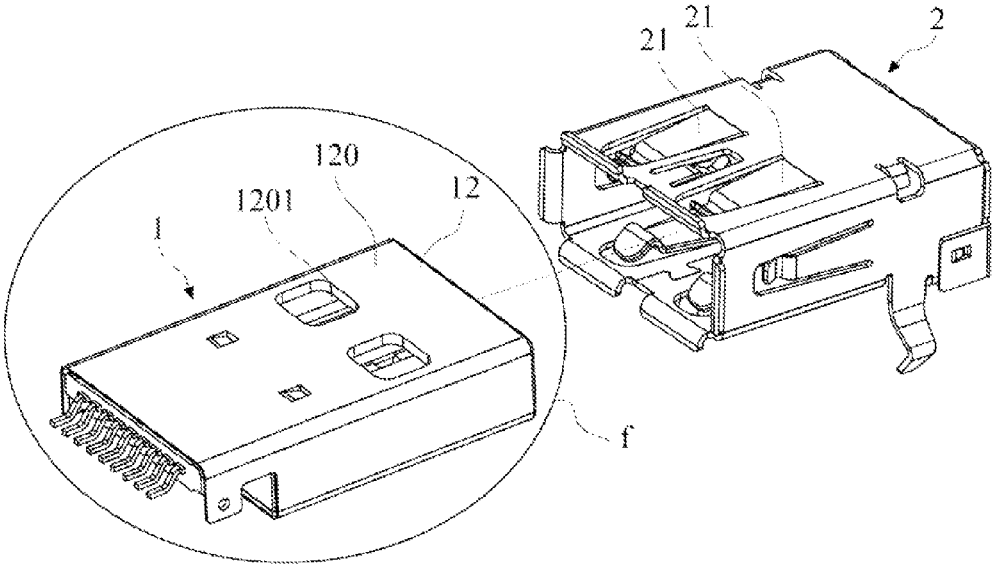
FIG. 15A is a perspective view of the plug connector and the receptacle connector shown in FIG. 12.
Figure 15B:
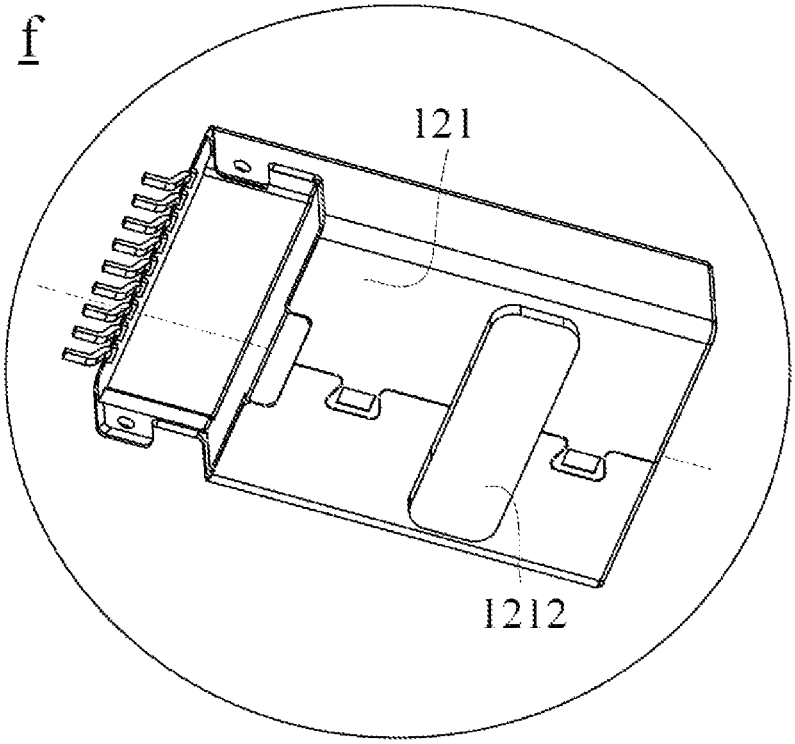
FIG. 15B is an enlarged view of the plug connector shown in FIG. 12.

Please refer to FIG. 15A which is a perspective view of the plug connector and the receptacle connector shown in FIG. 12 and FIG. 15B which is an enlarged view of the plug connector shown in FIG. 12. The embodiment of the present invention provides a plug connector 1 for connecting a receptacle connector 2. The receptacle connector 2 is a metal cover, and two resilient plates 21, 21' are formed respectively on the front side and the back side of the metal cover. When the plug connector 1 connected to the receptacle connector 2 each other, the metal shell 12 of the plug connector 1 will be received in the receptacle connector 2. And two locating portions 1201 with opening structures on the top plate 120 of the metal shell 12 (f, shown in FIG. 15A) and the elongated recess of the bottom plate 121 (f, shown in FIG. 15B) will lock with the resilient plates 21, 21' on the top and on the bottom of the receptacle connector 2. For example, the resilient plates 21 will lock the locating portions 1201, and the resilient plates 21' will connect to the elongated recesses 1213 or the periphery of the elongated recess 1213 for achieving the electrical connection between the plug connector 1 and the receptacle connector 2 and the grounding function. Furthermore, the bottom plate 121 of the metal shell 12 is stamped to form the elongated recess 1213 with a closed structure. When the plug connector 1 connects to the receptacle connector 2, there would be no spaces happened for avoiding any dust or tiny substances falling from such clearance to the resilient plates 21' into the metal shell 12 and preventing the connection failed between the first conductive terminal 112 of the plug connector 1 and the second conductive terminals 114 of the plug connector 1. Please be noticed that after the modification of the plug connector 1 as shown in FIG. 11 and FIG. 12, the plug connector 1 comprises the metal shell 12 with opening structure which the prior art didn't disclose and provides excellent shielding function because of the intact metal structure. Hence, the two resilient plates 21, 21' of the receptacle connector 2 could connect with the metal shell 12 firmly to avoid any EMI, the leakage of the electromagnetic wave in the metal shell 12 and the exterior intervention of the electromagnetic wave into the metal shell 12. Furthermore, it will also achieve dust prevention function and ensure stable insertion and extraction function after frequent uses of the plug connector and the receptacle connector. Obviously, this embodiment improves the long-term problems existing in the use of the plug connector.

the present embodiment is similar to FIG. 5, the elongated recess 1213 on the bottom plate 121 of the metal shell 12 in this embodiment could be formed by stamping process. And the opening structure could be stamped on the partial bottom of the elongated recess 1213, which is the same with the one disclosed in FIG. 5 and will be omitted in the following.

Figure 16A:
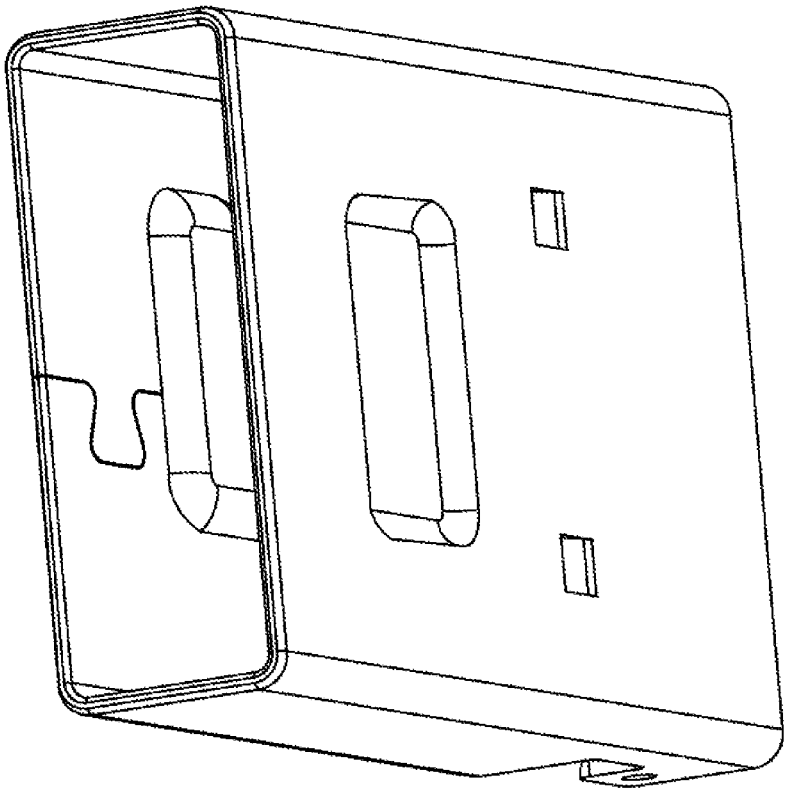
FIGS. 16A-16B are another perspective view of the metal shell.
Figure 16B:
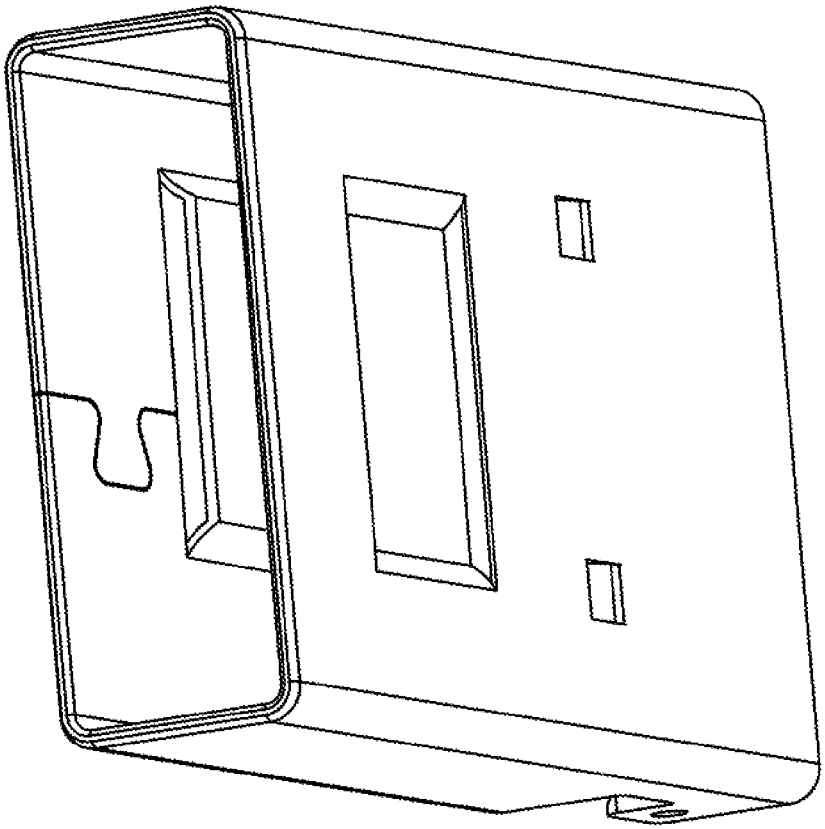

Similarly, this embodiment of the present invention adopts the locating portion 1201 with traditional hole on the top plate 120 of the metal shell 12 and the closed elongated recess 1213 on the bottom plate 121 of the metal shell 12. The opening structure could also be stamped on the partial bottom periphery of the elongated recess 1213. It is noticed that the elongated recess 1213 or the one with partial opening structure could be also formed on the locating portion 1201 of the top plate 120 opposite to the bottom plate 121. Thus both of the top plate 120 and the bottom plate 121 could respectively comprise the closed elongated recesses (shown in FIG. 16A) or the elongated recess 1213 with partial opening structures (shown in FIG. 16B). By the elongated recess 1213 with the closed or partial opening structure forming on both or one of the bottom plate 121 and the top plate 120, the resilient plates 21, 21' of the receptacle connector 2 could have firm contact with the metal shell 12 to avoid EMI and provide dust and tiny substance prevention function.

The objective of the present invention is to improve the traditional plug connector which forms holes on the top of the metal shell and tends to result in unstable electromagnetic shielding, EMI or crosstalk problems. According to the improvements of the foresaid embodiments in the present invention, such problems could be resolved. Besides, after recurrent tests, the mechanical force (insertion force and extraction force) is obviously increased and the lifetime of the plug connector 1 is extended. Besides, each of the embodiments of the present invention could be compatible with USB 2.0 plug connectors. For example, when the insulating housing 11 receives the first conductive terminals 112 only, and the first conductive terminals 112 are retained on the front end of the tongue portion 111. The USB 2.0 plug connector is provided.

Moreover, except for the modification of the top plate 120 of the metal shell 12 and the resilient plates 21, 21' of the receptacle connector 2 by using the same metal substance stamped to form at least a recess or protrusion for achieving excellent electromagnetic shielding function, EMI or crosstalk could also be improved by widening or minimizing the first conductive terminal 112 or the second conductive terminal 114 partially to stabilize the connection. Firstly please refer to FIG. 17 which is a bottom perspective view of the first conductive terminals 112 and the second conductive terminals 114 according to the first embodiment of the present invention. The first conductive terminals 112 comprise a first pair of signal terminals 1124, an electrical terminal 1125 and a power ground terminal 1126. The first pair of the signal terminals 1124 parallel are attached to the first terminal receiving space 1153 of the first body 115, and the first contact portion 1120' is exposed to the top surface 1151 of the first body 115. The first pair of the signal terminals 1124 are half-duplex differential signal lines (D+/D−) for half-duplex transmission or receiving the signal. The power terminal 1125 is parallel to the first pair of the signal terminals 1124 and retained in the first terminal receiving space 1153 of the first body 115. The first contact portion 1120" is exposed to the top surface 1151 of the first body. The power terminal 1125 is also attached to the left side of the first pair of signal terminals 1124 for providing power. The power ground terminal 1126 and the first pair of the signal terminals 1124 are parallel and retained in the first terminal receiving space 1153 of the first body 115. The first contact portion 1120'" is exposed to the top surface 1151 of the first body 115. The power ground terminal 1126 is accommodated on the right side of the first pair of the signal terminals for discharging the static electricity and avoiding any component damages caused from static electricity. It is noticed that the first pair of the signal terminals 1124, the first conductive terminal, the power terminal 1125 and the power ground terminal 1126 of the first conductive terminal are contact points for USB 2.0.

Figure 17:
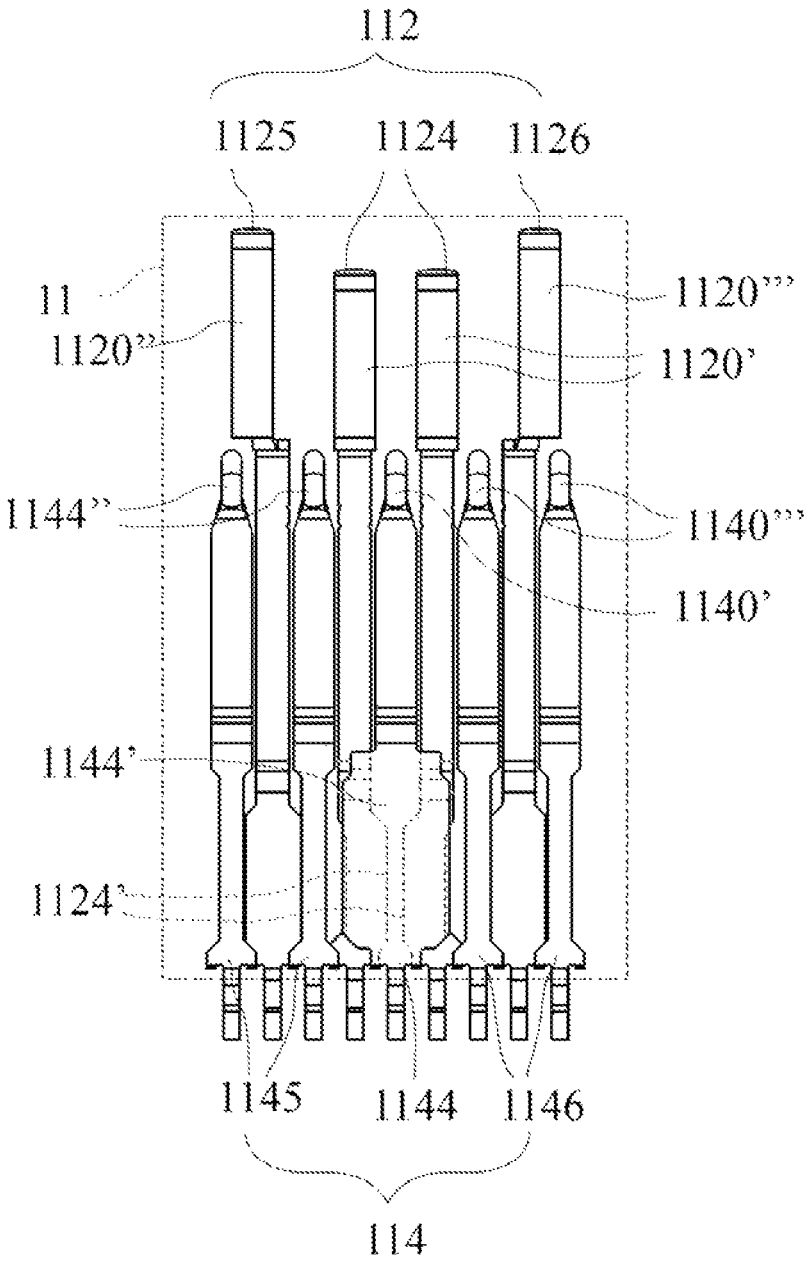
FIG. 17 is the bottom perspective view of the first conductive terminals and the second conductive terminals according to the first embodiment of the present invention.

Referring to FIG. 17, a plurality of the second conductive terminals 114 comprise a circuit ground terminal 1144, a second pair of the signal terminals 1145 and a third pair of signal terminals 1146. The circuit ground terminal 1144 parallel to the first conductive terminals 112 is accommodated in the second terminal receiving space 1163 of the second body 116, and the second contact portion 1140' extends on the front end of the second body 116. The circuit ground terminal 1144 is an electrical potential reference for providing the circuit with a reference point. The second pair of the signal terminals 1145 parallel to the first conductive terminals 112 are retained in the second terminal receiving space 1163 of the second body 116. The second pair of the signal terminals 1145 are accommodated on the left side of the circuit ground terminals 1144 and extend the second contact portion 1140" on the front end of the second body 116. The second pair of the signal terminals 1145 are simplex differential signal lines (SSTX+/SSTX−) for simplex signal transmission. The third pair of the signal terminals 1146 parallel to the first conductive terminals 112 are retained in the second terminal receiving space 1163 of the second body 116. The third pair of the signal terminals 1146 is further retained on the right side of the circuit ground terminal 1144 and extend the second contact portion 1140" on the front end of the second body 116. The third pair of the signal terminals 1146 are simplex differential signal lines (SSRX+/SSRX−) for receiving signals simplex. It is noticed that, the second conductive terminals 114 having the circuit ground terminal 1144, the second pair of the signal terminals and the third pair of the signal terminals 1146 are for connecting USB 3.0.

The second connecting portion 1144' of the circuit ground terminal 1144 is with a flat configuration and partially covers the first connection portion 1124' of the first pair of the signal terminals 1124. The first connection portion 1124' of the first pair of the signal terminals 1124 is moved inwardly to locate the shielding area of the second connecting portion 1144' of the circuit ground terminal 1144. Therefore it could avoid crosstalk interference induced by the first pair of the signal terminal 1124 (D+/D−) in the second pair of the signal terminals 1145 (SSTX+/SSTX−) and the third pair of the signal terminals 1146 (SSRX+/SSRX−).

Figure 18:
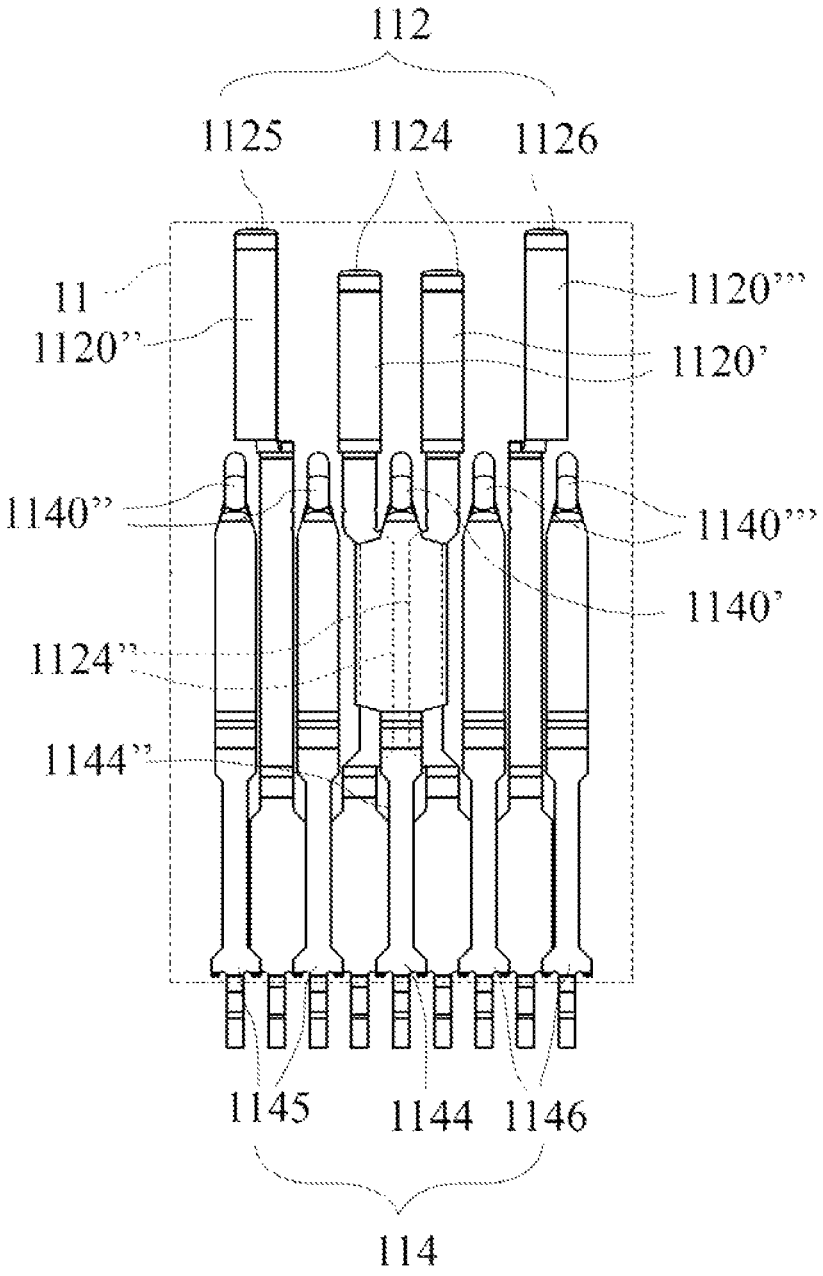
FIG. 18 is the bottom perspective view of the first conductive terminals and the second conductive terminals according to the second embodiment of the present invention.

Next please refer to FIG. 18 which is a bottom perspective view of the first conductive terminals and the second conductive terminals according to the second embodiment of the present invention. The difference between the first and the second embodiment are now disclosed. In the second embodiment, the second elongated portion 1144" of the circuit ground terminal 1144 is with flat configuration and partially covers the first elongated portion 1124" of the first pair of the signal terminals 1124. Each of the first elongated portions 1124" of the first pair of the signal terminals 1124 is moved inwardly in the shielding area of the second elongated portions 1144" of the circuit ground terminals. According to this design, it could avoid crosstalk interference induced by the first pair of the signal terminal 1124 (D+/D−) in the second pair of the signal terminals 1145 (SSTX+/SSTX−) and the third pair of the signal terminals 1146 (SSRX+/SSRX−). And all the other elements of the second embodiment are the same with the first embodiment and will not be disclosed in the following.

Figure 19:
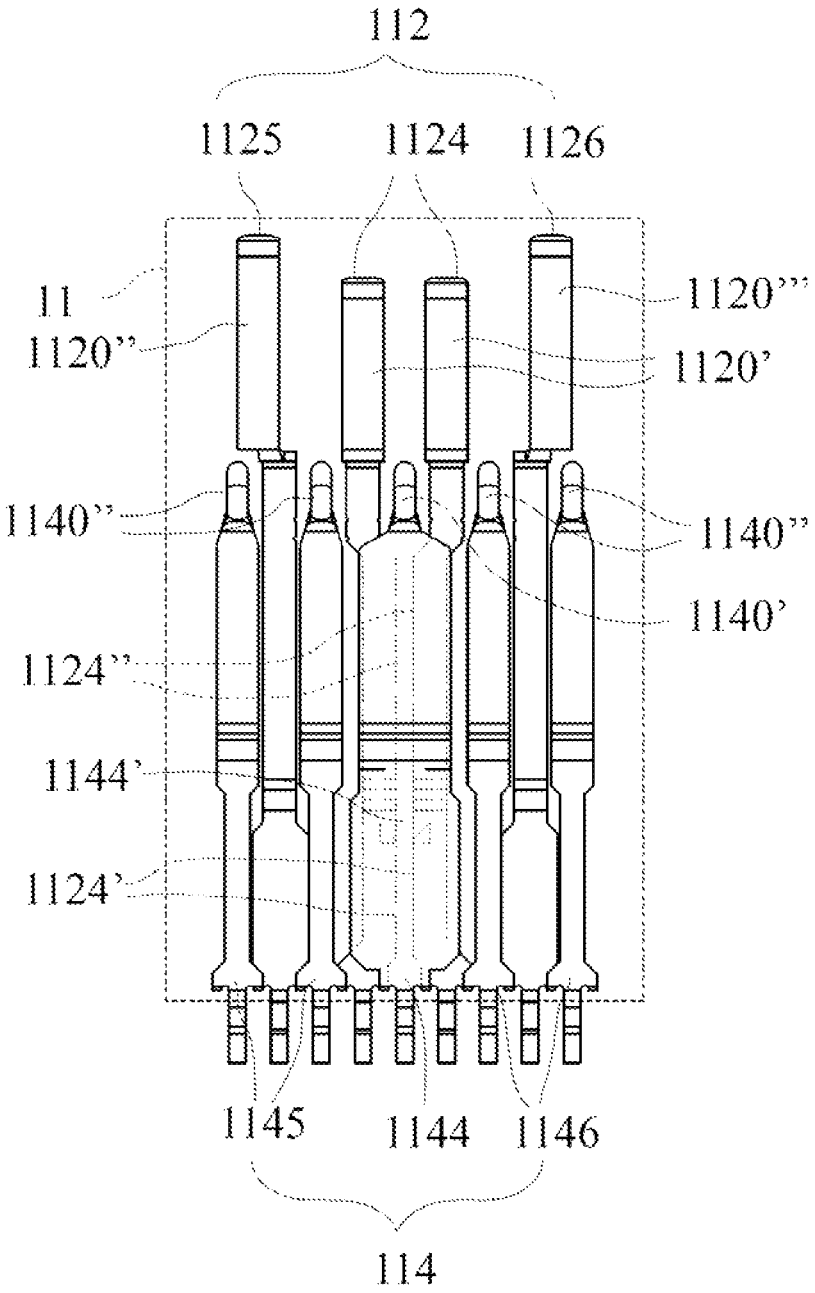
FIG. 19 is the bottom perspective view of the first conductive terminals and the second conductive terminals according to the third embodiment of the present invention.

Please Refer to FIG. 19 which is a bottom perspective view of the first conductive terminals and the second conductive terminals according to the third embodiment of the present invention. The third embodiment differs from the first and the second embodiment as follows. The portion of the circuit ground terminal 1144 where the second connecting portion 1144" connects with the second elongated portion 1141" is with flat configuration and partially covers the portion where the first connecting portion 1124' connects to the first elongated portion 1124". Each of the portion where the first connecting portion 1124' connects to the first elongated portion 1124" moves inwardly for being covered in the shielding area where the second connecting portion 1144' connects to the second elongated portion 1144". According to this design, it could avoid crosstalk interference induced by the first pair of the signal terminal 1124 (D+/D−) in the second pair of the signal terminals 1145 (SSTX+/SSTX−) and the third pair of the signal terminals 1146 (SSRX+/SSRX−). And the other elements of the third embodiment are the same with the first embodiment, and will not be described in the following.

Accordingly the first, second and the third embodiment of the present invention avoid crosstalk interference induced by the first pair of the signal terminal 1124 (D+/D−) in the second pair of the signal terminals 1145 (SSTX+/SSTX−) and the third pair of the signal terminals 1146 (SSRX+/SSRX−). These make the signal transmission more stable than prior art does.

In conclusion, the above embodiments of the present invention have been described by way of example only and not in any limitative sense. It will be appreciated by persons skilled in the art that various alterations and modifications maybe made in these embodiments without departing from the principles and spirit of the disclosure, the scope of which is defined in the claims and their equivalents.

What is claimed is:

1. A plug connector for connecting to a receptacle connector, the receptacle connector comprising a metal cover and a plurality of resilient plates respectively forming on a front side and a back side of the metal cover, characterized in that the plug connector comprises:

a plurality of first conductive terminals, wherein each of the first conductive terminals has a first contact portion, a first elongated portion, a first connecting portion and a first soldering portion arranged in order;

a plurality of second conductive terminals, wherein each of the second terminals has a second contact portion, a second elongated portion, a second connecting portion and a second soldering portion arranged in order;

an insulating housing for accommodating the first conductive terminals and the second conductive terminals, wherein the insulating housing has a first body and a second body covering the first body, a first terminal receiving space is formed on a top surface of the first body for retaining the first conductive terminals, a second terminal receiving space is formed on a bottom surface of the second body for retaining the second conductive terminals, the first soldering portion extends from a backside of the first terminal receiving space on the top surface, and the second contact portion and the second soldering portion extend from two opposite sides of the second terminal receiving space on the bottom surface; and a metal shell having a top plate, a bottom plate and two side plates, the two side plates connects to the top plate and the bottom plate for defining a receiving space, the insulating housing accommodated in the receiving space and assembled to the metal shell, wherein a plurality of recesses are formed on at least one of the top plate and the bottom plate for connecting to the resilient plates of the receptacle connector.

2. The plug connector as claimed in claim 1, wherein the recesses are closed structures.

3. The plug connector as claimed in claim 1, wherein the recesses have broken holes.

4. The plug connector as claimed in claim 1, wherein the plurality of the second conductive terminals are in parallel-spaced alignment by space, the plurality of first conductive terminals in parallel alignment are located in the spaces for being separated by the plurality of second conductive terminals and the plurality of first conductive terminals and the plurality of second conductive terminals are interlaced up and down arranging set.

5. The plug connector as claimed in claim 1, wherein the first terminals comprising:

a first pair of signal terminals located in the first terminal receiving space of a first body parallel to each other and exposing the first contact portion to the top surface of the first body;

a power terminal parallel to the first pair of signal terminals located in the first terminal receiving space of the first body; and a power ground terminal parallel to the first pair of signal terminals located in the first terminal receiving space of the first body and exposing the first contact portion to the top surface of the first body;

a power ground terminal parallel to the first pair of the signal terminals attached to the first terminal receiving space of the first body and exposing the first contact portion to the upper surface of the first body, wherein the power terminal and the power ground terminal parallel attached to the two sides of the first pair of the signal terminals; and the second pair of the conductive terminals further comprising:

a circuit ground terminal parallel attached to the second terminal receiving space of the second body and exposing the second contact portion to the front of the second body;

a second pair of signal terminals parallel attached to the second terminal receiving space of the second body, located on the left side of the circuit ground terminal and exposing the second contact portion to the front end of the second body; and a third pair of signal terminals parallel attached to the second terminal receiving space, located to the right side of the circuit ground terminal and exposing the second contact portion to the front end of the second body, wherein intervals are retained between the first contact portions of the first conductive terminals parallel to each other and the second contact portion of the second conductive terminals parallel to each other.

6. The plug connector as claimed in claim 5, wherein the second connecting of the circuit ground terminal is with a flat configuration, and each of the first connecting portions of the first pair of the signal terminals are moved inwardly and covered by the second elongated portion of the circuit ground terminal.

7. The plug connector as claimed in claim 5, wherein the second elongated portion of the circuit ground terminal is with a flat configuration, and each of the first elongated portions of the first pair of the signal terminals are moved inwardly and covered by the second elongated portion of the circuit ground terminal.

8. A plug connector for connecting to a receptacle connector, the receptacle connector comprising a metal cover and a plurality of resilient plates respectively forming on a front side and a back side of the metal cover, characterized in that the plug connector comprises:

a plurality of first conductive terminals, wherein each of the first conductive terminals has a first contact portion, a first elongated portion, a first connecting portion and a first soldering portion arranged in order;

a plurality of second conductive terminals, wherein each of the second terminals has a second contact portion, a second elongated portion, a second connecting portion and a second soldering portion arranged in order;

an insulating housing for accommodating the first conductive terminals and the second conductive terminals, wherein the insulating housing has a first body and a second body covering the first body, a first terminal receiving space is formed on a top surface of the first body for retaining the first conductive terminals, a second terminal receiving space is formed on a bottom surface of the second body for retaining the second conductive terminals, the first soldering portion extends from a backside of the first terminal receiving space on the top surface, and the second contact portion and the second soldering portion extend from two opposite sides of the second terminal receiving space on the bottom surface; and a metal shell having a top plate, a bottom plate and two side plates, the two side plates connecting to the top plate and the bottom plate and defining a receiving space, the insulating housing accommodated in the receiving space and assembled to the metal shell, wherein a plurality of protrusions are formed on at least one of the top plate and the bottom plate for connecting to the resilient plates of the receptacle connector.

9. The plug connector as claimed in claim 8, wherein the protrusions are closed structures.

10. The plug connector as claimed in claim 8, wherein the plurality of the second conductive terminals are in parallel-spaced alignment by spaces, the plurality of first conductive terminals in parallel alignment are located in the spaces for being separated by the plurality of second conductive terminals and the plurality of first conductive terminals and the plurality of second conductive terminals are interlaced up and down arranging set.

11. The plug connector as claimed in claim 8, wherein the first conductive terminals comprising:

a first pair of signal terminals located in the first terminal receiving space of the first body parallel to each other and exposing the first contact portion to the top surface of the first body;

a power terminal parallel to one side of the first pair of signal terminals located in the first terminal receiving space of the first body; and a power ground terminal parallel to the other side of the first pair of signal terminals attached to the first terminal receiving space of the first body and exposing the first contact portion to the top surface of the first body; and the second conductive terminals further comprising:

a circuit ground terminal parallel attached to the second terminal receiving space of the second body and exposing the second contact portion to the front of the second body;

a second pair of signal terminals parallel attached to the second terminal receiving space of the second body, located on the left side of the circuit ground terminal and exposing the second contact portion to the front end of the second body; and a third pair of signal terminals parallel attached to the second terminal receiving space, located to the right side of the circuit ground terminal and exposing the second contact portion to the front end of the second body, wherein intervals are retained between the first contact portions of the first conductive terminals parallel to each other and the second contact portion of the second conductive terminals parallel to each other.

12. The plug connector as claimed in claim 11, wherein the second connecting portion of the circuit ground terminal is with a flat configuration, and each of the first connecting portions of the first pair of signal terminals are moved inwardly and covered by the second connecting portion of the circuit ground terminal.

13. The plug connector as claimed in claim 11, wherein the second elongated portion of the circuit ground terminal is with a flat configuration, and each of the first elongated portions of the first pair of signal terminals are moved inwardly and covered by the second elongated portion of the circuit ground terminal.

14. A plug connector for connecting to a receptacle connector, the receptacle connector comprising a metal cover and a plurality of resilient plates respectively forming on a front side and a back side of the metal cover, characterized in that the plug connector comprises:

a plurality of first conductive terminals, wherein each of the first conductive terminals has a first contact portion, a first elongated portion, a first connecting portion and a first soldering portion arranged in order;

a plurality of second conductive terminals, wherein each of the second terminals has a second contact portion, a second elongated portion, a second connecting portion and a second soldering portion arranged in order;

an insulating housing for accommodating the first conductive terminals and the second conductive terminals, wherein the insulating housing has a first body and a second body covering the first body, a first terminal receiving space is formed on a top surface of the first body for retaining the first conductive terminals, a second terminal receiving space is formed on a bottom surface of the second body for retaining the second conductive terminals, the first soldering portion extends from a backside of the first terminal receiving space on the top surface, and the second contact portion and the second soldering portion extend from two opposite sides of the second terminal receiving space on the bottom surface; and a metal shell having a top plate, a bottom plate and two side plates, the two side plates connecting to the top plate and the bottom plate and defining a receiving space, the insulating housing accommodated in the receiving space and assembled to the metal shell, wherein elongated recesses are formed on at least one of the top plate and the bottom plate for connecting to the resilient plates of the receptacle connector.

15. The plug connector as claimed in claim 14, wherein the elongated recesses are closed structures.

16. The plug connector as claimed in claim 14, wherein the protrusions have broken holes.

17. The plug connector as claimed in claim 14, wherein the plurality of the second conductive terminals are in parallel-spaced alignment by space, the plurality of first conductive terminals in parallel alignment are located in the spaces for being separated by the plurality of second conductive terminals and the plurality of first conductive terminals and the plurality of second conductive terminals are interlaced up and down arranging set.

18. The plug connector as claimed in claim 14, wherein the first conductive terminals comprising:

a first pair of signal terminals located in the first terminal receiving space of the first body parallel to each other and exposing the first contact portion to the top surface of the first body;

a power terminal parallel to one side of the first pair of signal terminals located in the first terminal receiving space of the first body; and a power ground terminal parallel to the other side of the first pair of signal terminals attached to the first terminal receiving space of the first body and exposing the first contact portion to the top surface of the first body; and the second conductive terminals further comprising:

a circuit ground terminal parallel attached to the second terminal receiving space of the second body and exposing the second contact portion to the front of the second body;

a second pair of signal terminals parallel attached to the second terminal receiving space of the second body, located on the left side of the circuit ground terminal and exposing the second contact portion to the front end of the second body; and a third pair of signal terminals parallel attached to the second terminal receiving space, located to the right side of the circuit ground terminal and exposing the second contact portion to the front end of the second body, wherein intervals are retained between the first contact portions of the first conductive terminals parallel to each other and the second contact portion of the second conductive terminals parallel to each other.

19. The plug connector as claimed in claim 18, wherein the second connecting portion of the circuit ground terminal is with a flat configuration, and each of the first connecting portions of the first pair of signal terminals are moved inwardly and covered by the second connecting portion of the circuit ground terminal.

20. The plug connector as claimed in claim 18, wherein the second elongated portion of the circuit ground terminal is with a flat configuration, and each of the first elongated portions of the first pair of signal terminals are moved inwardly and covered by the second elongated portion of the circuit ground terminal.

* * * * *